US007246558B2

(12) United States Patent
Hilden

(10) Patent No.: US 7,246,558 B2
(45) Date of Patent: Jul. 24, 2007

(54) RAPID DEFLAGRATION CORD (RDC) ORDNANCE TRANSFER LINES

(75) Inventor: Lynn G. Hilden, Hollister, CA (US)

(73) Assignee: McCormick Selph, Inc., Hollister, CA (US)

( * ) Notice: Subject to any disclaimer, the term of this patent is extended or adjusted under 35 U.S.C. 154(b) by 178 days.

(21) Appl. No.: 10/085,069

(22) Filed: Mar. 1, 2002

(65) Prior Publication Data

US 2003/0164107 A1 Sep. 4, 2003

(51) Int. Cl.
*C06C 5/00* (2006.01)

(52) U.S. Cl. ..... 102/275.1; 102/275.4; 102/275.5

(58) Field of Classification Search . 102/275.1–275.12
See application file for complete search history.

(56) References Cited

U.S. PATENT DOCUMENTS 2,535,518 A * 12/1950 Rich ..... 102/275.6
2,857,845 A * 10/1958 Seavey ..... 102/275.2
3,326,127 A * 6/1967 Schimmel ..... 102/275.2
3,851,587 A * 12/1974 Alchorn et al. ..... 102/275.8
3,990,367 A * 11/1976 Smith ..... 102/275.8
4,612,857 A * 9/1986 Schimmel ..... 102/275.2
4,664,033 A * 5/1987 Burkdoll et al. ..... 102/275.11
4,991,511 A * 2/1991 Simpson ..... 102/275.1
5,031,538 A * 7/1991 Dufrane et al. ..... 102/275.11
5,223,664 A * 6/1993 Rogers ..... 102/275.1
5,365,851 A * 11/1994 Shaw ..... 102/275.11
5,406,889 A * 4/1995 Letendre et al. ..... 102/201
5,417,162 A * 5/1995 Adams et al. ..... 102/275.11
5,518,268 A * 5/1996 Moore et al. ..... 280/737
5,540,154 A * 7/1996 Wilcox et al. ..... 102/275.1
5,689,083 A * 11/1997 Hadden ..... 102/275.12
5,747,722 A * 5/1998 Gladden et al. ..... 102/275.9
6,006,671 A * 12/1999 Yunan ..... 102/275.11
6,247,410 B1 * 6/2001 Garcia ..... 102/275.9

(Continued)

FOREIGN PATENT DOCUMENTS

GB 2140137 A * 11/1984 ..... 102/275.1

*Primary Examiner*—James S. Bergin
(74) *Attorney, Agent, or Firm*—Robert E. Bushnell, Esq.

(57) ABSTRACT

A novel transfer ordnance line and novel end fittings for the transfer line for use in space vehicles, aircraft, missile systems and other military applications. The transfer line is a Rapid Deflagration Cord (RDC) hermetically encapsulated in a metal tubing. The metal tubing terminates at end fittings such as a loaded high energy (HE) end fitting which detonates, a low energy (LE) end fitting which burns, and a percussion primer used to start burning of the RDC in the transfer line. The transfer line is constructed so that gases produced during the burning of the RDC do not escape and pose a threat to the surroundings during functioning and so moisture does not enter the system during shelflife, transportation, or at any other time prior to functioning. With minor adjustments to the transfer tube and the end fittings, the transfer tubing can be made flexible by forming a coil. With minor adjustments, a loaded HE end fitting can be made into a separation end fitting used ejected devices that must remain on course. Loaded HE end fittings may be placed in a manifold where it will ignite one or more loaded HE and LE end fittings to further progress the reaction. Loaded LE end fittings may be placed in transfer manifolds joining one or more other loaded LE end fittings to progress the reaction.

12 Claims, 39 Drawing Sheets

U.S. PATENT DOCUMENTS 6,435,095 B1 * 8/2002 Menzel et al. ..... 102/275.7
6,467,415 B2 * 10/2002 Menzel et al. ..... 102/275.1
6,536,798 B1 * 3/2003 Hamilton ..... 102/275.6

* cited by examiner

490

490

1070

1070

2085

.11

A
SH 2
.266
4X .11
4X Ø .060 .054
.532
A
-A-

2630
1.187 □
4X 45°
2X Ø .190 .178
.010 A B C
.414
2640
2650
.414
.414
.594
-B-
4X .16
-C-
.594
.414
2660
2600

SCALE 2:1
2610
2620

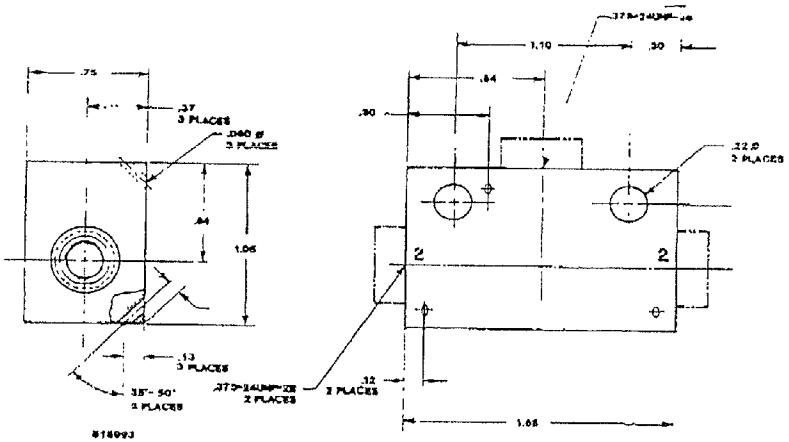
Fig 26J
Fig 26I
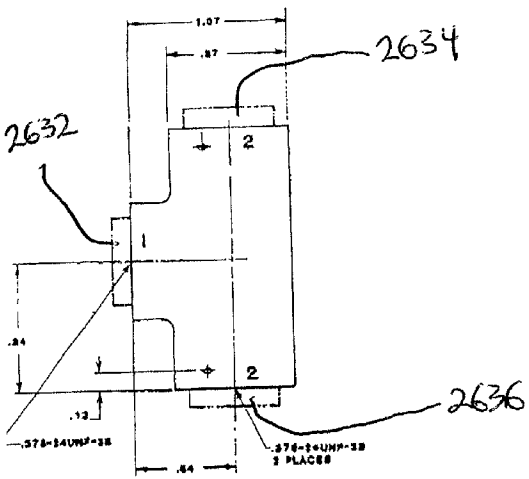
Fig 26L
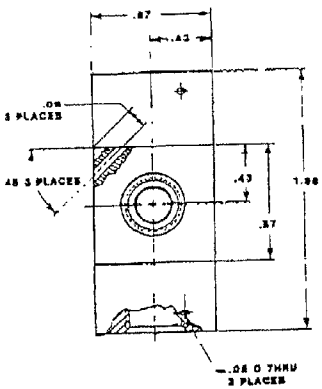
Fig 26K
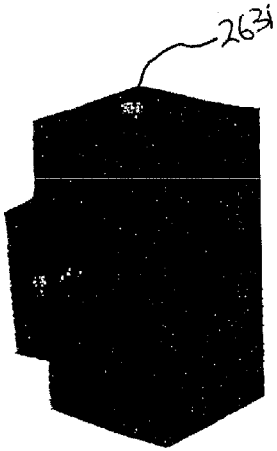
Fig 26H

2810

3010

3100

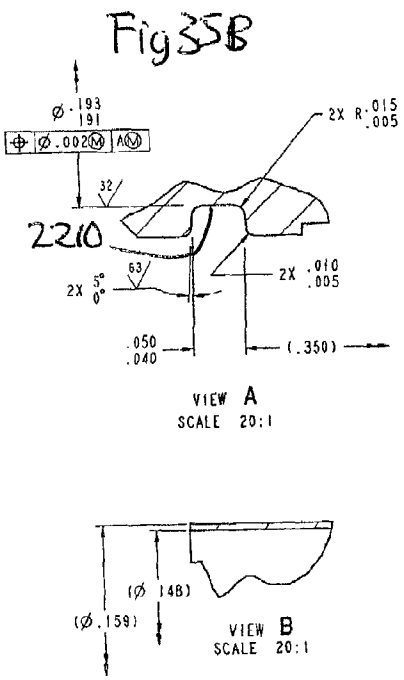
Fig35B
Fig35C
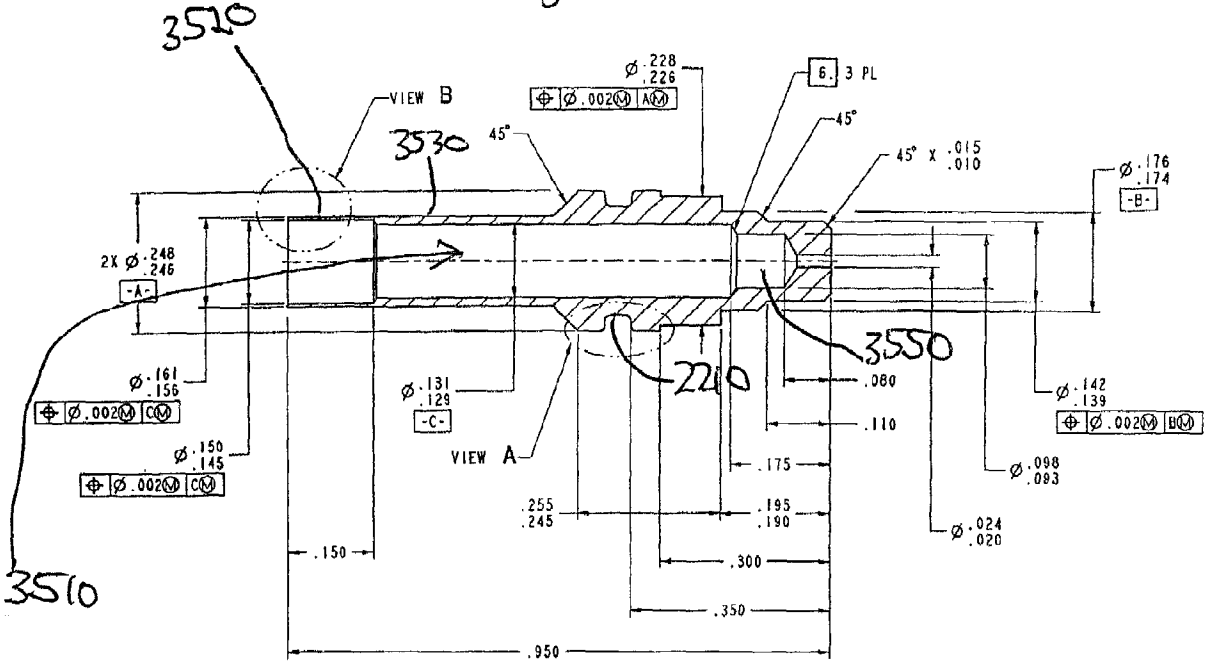
Fig35A

368

360

RAPID DEFLAGRATION CORD (RDC) ORDNANCE TRANSFER LINES

CLAIM OF PRIORITY

This invention makes reference to and herein incorporates by reference Disclosure Document No. 503414 filed in the U.S. Patent Office on Jan. 14, 2002 and claims all benefits of said document provided by the Disclosure Documents Program described in MPEP § 1706 in the eighth edition of the MPEP.

BACKGROUND OF THE INVENTION

Field of the Invention

The technology is the use of Rapid Deflagrating Cord (RDC) as the ordnance transfer medium for a flexible, hermetically sealed stainless steel line. The lines take an ignition from one source to another quickly and safely with high reliability.

Current technology of transfer lines, particularly for high reliability applications, consists of Shielded Mild Detonating Cord (SMDC), Flexible Confined Detonating Cord (FCDC) and Shock Tube (Ensign Bickford Trademark, same as TLX from OEA). The lower level transfer lines are like "Jet Cord" or "Prima Cord" that are used extensively in commercial mining type applications.

Explosive Transfer Lines (ETL's, a generic name for the above lines) many times are used in environments where it is necessary to fully contain the products of combustion. This may be due to use near sensitive equipment such as that used in space satellites or it might be near an explosive atmosphere such as aviation fuel. Out gassing of the explosive gas or residue can be dangerous and detrimental to surrounding equipment. When it is absolutely necessary to contain any products of combustion, SMDC becomes the product of choice. SMDC is a Mild Detonating Cord (MDC) contained inside stainless steel hydraulic tubing. Because the MDC has very high pressures generated by it's function, it is necessary to use relatively large diameter (0.190-inch) tubing with a wall thickness of 0.0225-inch. This tubing is very stiff. It becomes necessary to pre-bend the tubing for the specific installation desired. It is stiff and difficult to install in many instances. The flexible lines, FCDC, TLX, etc. are very difficult to contain during use.

Rapid Deflagrating Transfer Lines (RDTL) use less energetic materials and can therefore be more easily contained. This allows the use of smaller diameter stainless steel tubing and smaller thickness of the wall. In the current configuration the tubing is 0.094-inch diameter with 0.016 thick walls. This makes the lines easier to install because they can be bent as necessary for installation. Once installed the tubing offers more support than other flexible lines because it is still stainless steel and therefore stiff.

Rapid Deflagrating Cord (RDC) has been used for many years for transferring ignition signals. The Harpoon Missile Starter Cartridges and Igniters use such a system (See Data Sheet provided). For applications such as this, RDC is wrapped with fiberglass, Kevlar, nylon or wire weave and plastic coated. Another interesting application has been the use of the raw cord as an igniter. This application is most common in passenger side airbag inflators.

The closest similar art is the Shock Tube or TLX. In the case of these products, a detonating material is extruded on the inner surface of a plastic tube. When a detonation is introduced to the tube, it will detonate along the inside surface of the tubing to transfer from end to end. Known problem areas with these products have been high vibration levels, especially found in aerospace applications which cause the explosives to fall loose and then venting the lines when fired at the pooling area (low point in the line) due to a higher than normal amount of energy concentrated at one point. These lines also routinely separate at the end fittings of the high energy end tips. Since they are more flexible than the RDTL, there may be other implications in a flight environment.

SUMMARY OF THE INVENTION

It is therefore an object of the present invention to provide an improved ordnance transfer line system having improved Percussion Primer (PP) end fittings and improved detonating High Energy (HE) and a booster charge Low Energy (LE) loaded end fittings as well as improved transfer lines between HE to HE, HE to LE and LE to LE loaded end fittings that maintain a hermetic seal between the explosive or flammable material and the environment preventing moisture from entering the system prior to use during shelflife and preventing the escape of produced gases during and after functioning when the end fittings are properly installed into transfer manifolds or other suitable assemblies.

It is also an object of the present invention to provide a unique design and implementation of a ferrule for PP, LE and HE end fittings, the ferrule serving as a connecting part between the transfer line and the manifold to which end fittings are installed providing a hermetic seal both prior to, during and after use of the end fitting preventing moisture from entering and corrupting the booster material and/or detonation material while preventing the escape of gases generated by the ignition of booster and detonating chemicals stored within a loaded end fitting.

It is further an object of the present invention to provide a transfer line system where the ferrule forms a hermetic seal between a loaded end fitting and a transfer line and between the loaded end fitting and a transfer manifold or other suitable assembly.

It is also an object of the present invention to provide a transfer line that can have a portion of the line that is fully flexible so that the line can safely transfer energy when flexed in excess of 50,000 times in the case it is located on items that open and close a lot, like doors, for example.

It is still also an object of the present invention to provide a transfer line where the entire transfer line is semi-flexible due to the thickness and diameter of the metallic encapsulating tubing allowing end portions containing end fittings to be easily fitted into spatially fixed transfer manifolds.

It is further an object of the present invention to provide an ordnance transfer line system that is immune to normal aerospace vibration levels while prior ordnance transfer lines have proven to be subject to vibration degradation of the line.

It is yet further an object of the present invention to provide a transfer line system that does not require venting of gases generated by the burning of a transfer cord nor other flammable material or generated by detonation without causing an encasing material surrounding the cord from exploding, allowing the transfer lines, end fittings and transfer manifolds to pass safely through potentially explosive or potentially flammable environments safely.

It is still an object of the present invention to provide a transfer line that expends only a small amount of energy yet is able to ignite HE or burn LE material at the end of the line.

It is yet also an object of the present invention to provide a unique design for a LE and HE end fittings where a closure cup is welded to the ferrule, the reactionary chemicals being disposed near said cup and near a bottom of said closure cup in the case of an LE end fitting, said cup having a coined section on said bottom of said closure cup which is thinner than other portions of said cup in the case of an LE end fitting resulting in maintaining a hermetic seal and allowing the outflow of gases when ignited and preventing the inflow of moisture prior to use for both HE and LE end fittings.

It is yet another object of the present invention to provide a LE end fitting that has an annular silicone rubber or copper seal that seals to the transfer manifold that the LE end fitting is inserted into to prevent the inflow of moisture prior to use and the outflow of gases during and after use.

It is still yet another object of the present invention to provide LE and HE end fittings where a connecting ferrule is laser beam welded to the outside portion of the transfer line causing retention of the ferrule to the transfer line preventing gases produced during ignition or detonation of a charge from escaping into the environment while preventing intrusion of moisture to the charge chemical prior to use.

It is further yet another object of the present invention to crimp one end of the connecting ferrule of an HE and LE end fitting to the transfer line preventing the ferrule from separating from the transfer line during ignition or detonation thus maintaining a hermetic seal preventing the leakage of gases during and after use while preventing the influx of moisture to the chemical charge prior to use.

It is still further an object to provide a transfer line that can be used in stage separation of launched space vehicles, enabling a stage to be ejected while separating the end fitting used to trigger the ejection preventing unwanted changes in direction of the launch vehicle caused by the trailing ends of said transfer line used to initiate separation.

These and other objects can be achieved by an energy transfer system that begins with a novel transfer line containing a Rapid Deflagration Cord (RDC) hermetically sealed in a metal tubing, said metal preferably being Stainless Steel. The cord deflagrates as it transmits energy at a rate of 1000 to 1500 feet per second to a distal point where it can trigger a loaded LE end fitting or a loaded HE end fitting hermetically sealed within a transfer manifold to ignite other LE and HE end fittings located within the same transfer manifold causing further energy transfers along other transfer lines that will eventually lead to the performance of a function such as stage separation of a space vehicle, ejection of an item, igniting a starter cartridge, igniting a pressure cartridge, initiating a flame front, function a pin puller or initiating a shape charge for canopies on aircraft or destruct systems. These functions are first initiated by first setting off a percussion primer located in an end fitting and having the energy transferred through one or more links of transfer line containing RDC to a destination. Both ends of a transfer line are fitted onto end fittings that are fitted into transfer manifolds. End fittings include a closure cup, a ferrule, a seal and a booster. The novelty of the present invention is a unique combination of seals, weldings, crimpings, implementation and design of a closure cup, as well as a unique design of a ferrule used to bind together a transfer manifold to a transfer line. These features serve to create a hermetic seal between the flammable or detonating chemicals inside the energy transfer system and the outside environment by 1) preventing moisture from entering the system that could damage the chemical materials used in the transfer of energy during storage and transportation and 2) prevent the escaping of harmful gases produced upon burning or detonating said chemical material either inside a transfer line or in an end fitting. Therefore, with the exception of separation end fittings after functioning, each end fitting must be hermetically sealed to a transfer manifold and each end fitting must be hermetically sealed to transfer line where the hermetic seal must be both durable to withstand long shelflife and be strong enough to contain gases during an explosion. The RDC is encapsulated by a metal tubing that has an inner and an outer diameter that allows the entire transfer line to be semi-flexible providing easy installation of the transfer lines containing end fittings into fixed transfer manifolds. In addition, portions of a transfer line can be made very flexible and able to withstand over 50,000 flexes by forming a coil with the transfer line that allows the transfer line to be installed in doors and hatches where frequent flexure is inevitable.

For stage separation, a special end fitting is used where the connecting ferrule becomes detached from the transfer line during detonation of an explosive in an HE end fitting. Such separation end fittings is an exception where the hermetic seal is broken after functioning. Uses for separation end fittings include stage separation of launched space vehicles, ejection of other items such as bombs or missiles fired from aircraft or ships or any other application where ejection is accomplished. The separation of the ferrule from the transfer line minimizes the unwanted changes in direction the ejected item undergoes caused by the trailing ends of an end fitting.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein:

FIG. 26H illustrates a plan view of a three-port transfer manifold that joins together a 3 loaded HE end fittings similar to the loaded HE end fitting illustrated in FIG. 20;

FIGS. 26I-26L illustrates cross-sectional views of the 3-port transfer manifold illustrated in FIG. 26H into which loaded HE end fittings similar to the loaded HE end fittings illustrated in FIG. 20 may be fitted into;

FIGS. 35A-35C illustrate cross-sectional views of the ferrule used in the loaded HE separation end fitting illustrated in FIG. 33 according to the principles of the present invention.

DETAILED DESCRIPTION OF THE INVENTION

Figure 1:
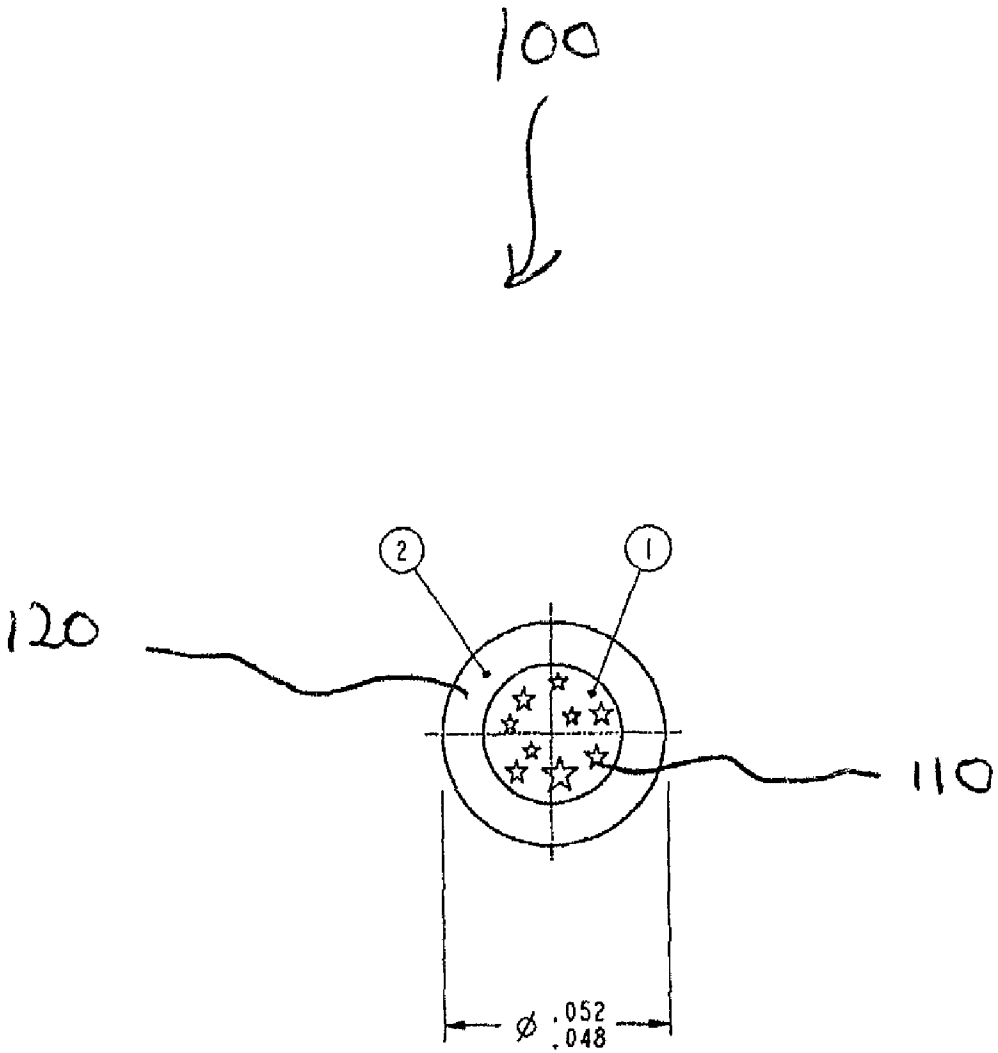
FIG. 1 is a cross-sectional view of a Rapid Deflagration Cord (RDC) according to the principles of the present invention.

Turning to the figures, FIG. 1 illustrates a cross-sectional view of the Rapid Deflagration Cord (RDC) 100 according to the principles of the present invention. The center portion 110 of the RDC 100 is an explosive mix called Rapid Deflagration Material (RDM) comprised of a fuel such as $Cs_2B_{12}H_{12}$mixed with an oxidizer such as $KNO_3$. The RDM 110 is surrounded and encapsulated by an aluminum tubing 120. The diameter of the RDM 110 and the tubing 120 is preferably 0.050 inches. The RDM burns at a rate of 1000 to 1500 feet per second and emits gases that are not allowed to escape due to a hermetic seal to be later discussed.

Figure 2:
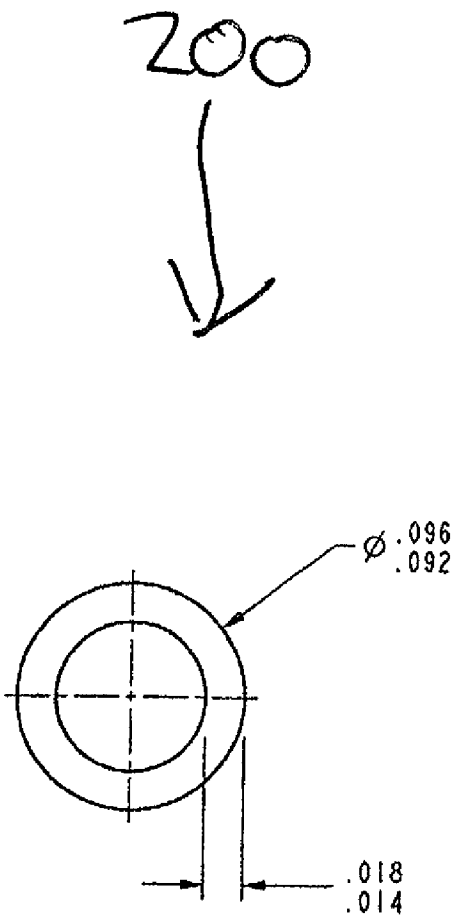
FIG. 2 is a cross sectional view of the metallic tubing that encapsulates the RDC of FIG. 1 according to the principles of the present invention.

FIG. 2 illustrates a cross-sectional view of the encapsulating tubing 200 that encapsulates the RDC 100 of FIG. 1. This tubing is preferably made of stainless steel and preferably has thickness of 0.016 inches, an inner diameter of 0.062 inches and an outer diameter of 0.094 inches. This provides a 0.006 inch gap between RDC 100 and the inner wall of tubing 200. As will be seen later, this tubing 200 provides for a hermetic seal for RDC 100.

Figure 3:
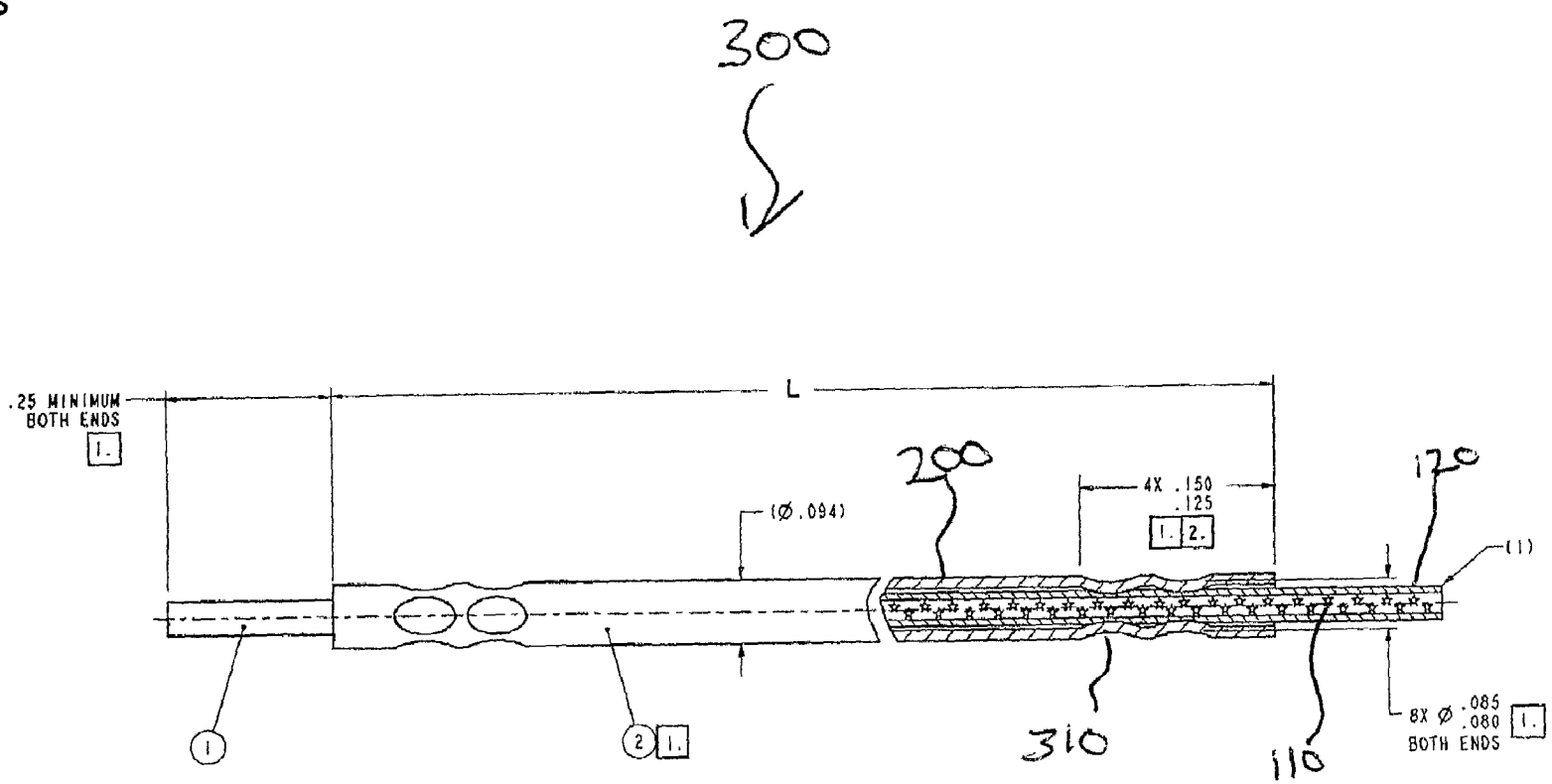
FIG. 3 is a lengthwise cross-sectional view of the RDC and encapsulating tubing illustrated in FIGS. 1 and 2 according to an embodiment of the present invention.

FIG. 3 illustrates a cut-out view of the inventive transfer line 300 according to the preferred embodiment of the present invention. As illustrated, RDC 100 is surrounded by tubing 200 which forms a hermetic seal for RDC 100 when end fittings are assembled. FIG. 3 illustrates a crimped (or staked) portion 310 used to hold the RDC in place. With such a configuration, 1) the stainless steel tubing is semi-flexible, allowing the tubing to bend slightly so that it, along with end fittings, can be made to fit into fixed transfer manifolds and 2) the gases generated by this preferred size of RDC will not rupture the tubing, the end fittings or the manifolds when burned. Of great importance is that the dimensions described for the inventive transfer line allow the transfer line to be semi-flexible. When a transfer line has loaded end fittings on each side and need to be fitted into spatially fixed transfer manifolds, the transfer line can bend to a degree to enable the end fittings to be easily fitted into transfer manifolds.

Figure 4:
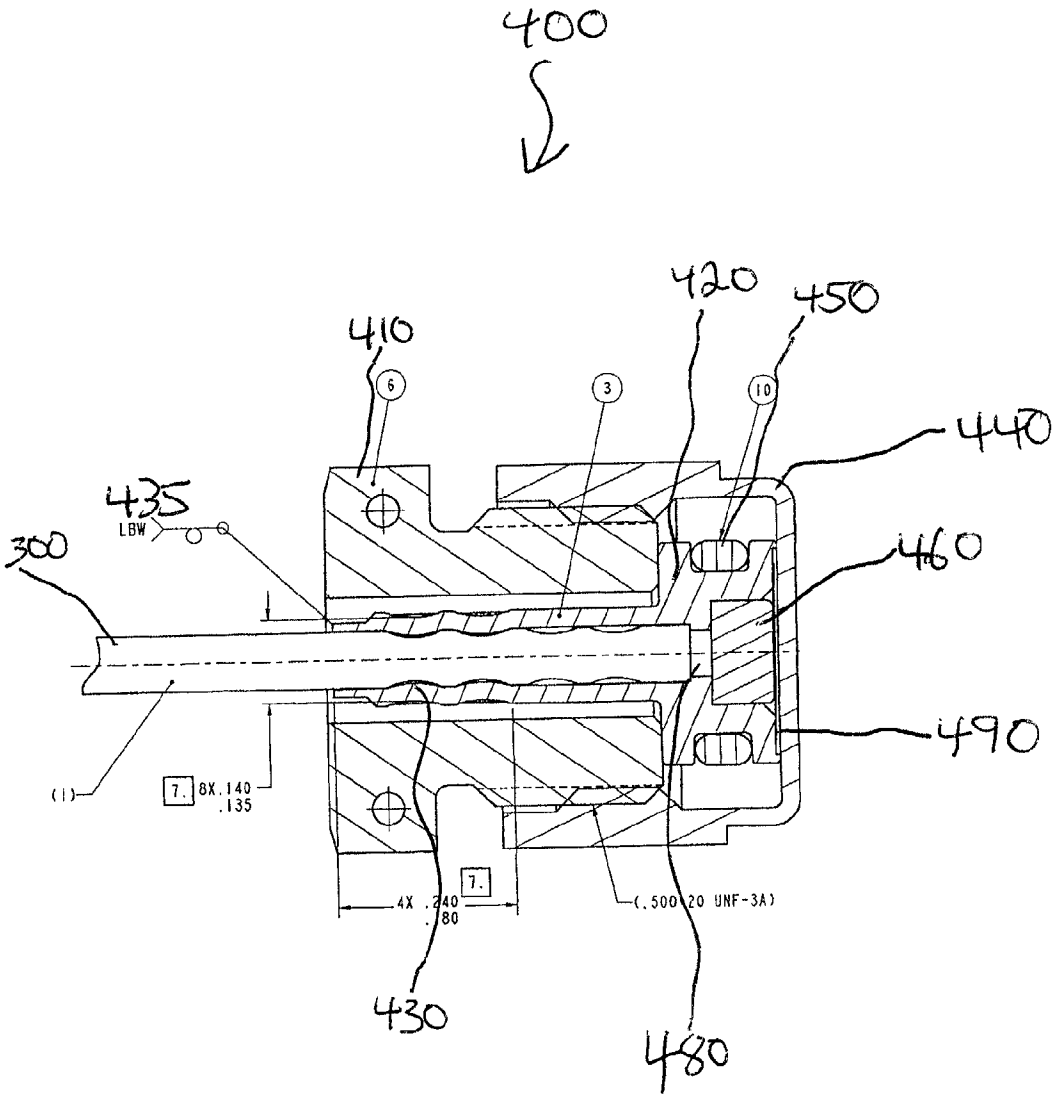
FIG. 4 is a cross-sectional view of a percussion primer end fitting according to the principles of the present invention.

FIG. 4 illustrates a cross-sectional view 400 in detail of the percussion primer end fitting 120 illustrated in FIG. 1 attached to transfer line 300. B-nut 410 firmly holds percussion primer end fitting 400 in place. Ferrule 420 is preferably made of stainless steel and serves to firmly attach the percussion primer end fitting 400 to the transfer line 300. Ferrule 420 is a metallic material and extends from the ignition portion 460 of percussion primer end fitting 400 to transfer line 300. Plastic cap 440 serves to protect the ignition portion and the entire end fitting of the percussion primer during shelflife and during transportation. Prior to use of percussion primer end fitting 400, plastic cap 440 is removed from the percussion primer end fitting. Ferrule 420 at the end near the ignition portion has an annular groove 540 having an O-ring 450 disposed therein. O-ring 450 is preferably made of Silicone rubber and serves to prevent gases produced during functioning of the percussion primer 460 and RDC 100 not to escape when the end fitting 400 is inserted into another assembly such as an arm fire handle (not shown). Transfer line 300 is inserted into end fitting 400 for percussion primer 460. In the center of the transfer line is a Rapid Deflagration Cord (RDC) 100 that serves to transfer energy along the transfer line 300 by the burning of the RDC 100. RDC 100 is encapsulated by a metallic tubing 200. Preferably, this tubing 200 is stainless steel but it can be appreciated that other metals will also work. Metallic tubing 200 produces a hermetic seal around RDC 100 preventing escape of gases generated by the burning of RDC 100. RDC 100 is made thin enough so that too much gas is not produced which could result in a rupture of metallic tubing 200. O-ring 450 also serves to produce a hermetic seal once the transfer line is installed into another assembly. O-ring 450 is preferably made out of Silicone rubber. Ferrule 420 and metallic tubing 200 as well as RDC 100 are firmly held together by staking (or crimping) together ferrule 420 and metallic tubing 200 within the end fitting 400 having percussion primer 460. This staking or crimping is referred to as reference number 430. Crimping 430 is illustrated in FIG. 4 as curved portions of metallic tubing 200 and ferrule 420 to serve to pinch RDC 100 in place. On the right side of FIG. 4 is the percussion primer 460 of the percussion primer end fitting 400. The ignition portion 460 is functioned by a firing pin similar to that found in an ordinary rifle. The firing pin (not shown) strikes a closure disk 490 and produces an impact sufficient to ignite the percussion powders found in percussion primer 460 that, in turn ignites RDC 100 when a spark is transferred across through hole 480. In the preferred embodiment, the closure disk 490 is stainless steel and is 0.001 through 0.002 inches thick. Therefore the ignition portion 460 serves to ignite and start the burning of RDC 100. The mechanics of how a firing pin is used to ignite a percussion primer is well known in the art and the description is therefore omitted.

Figure 5B:
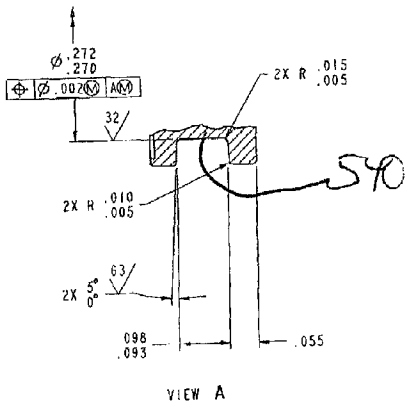
FIGS. 5A and 5B are cross-sectional views of the ferrule illustrated in FIG. 4 for a percussion primer end fitting according to the principles of the present invention.
Figure 5A:
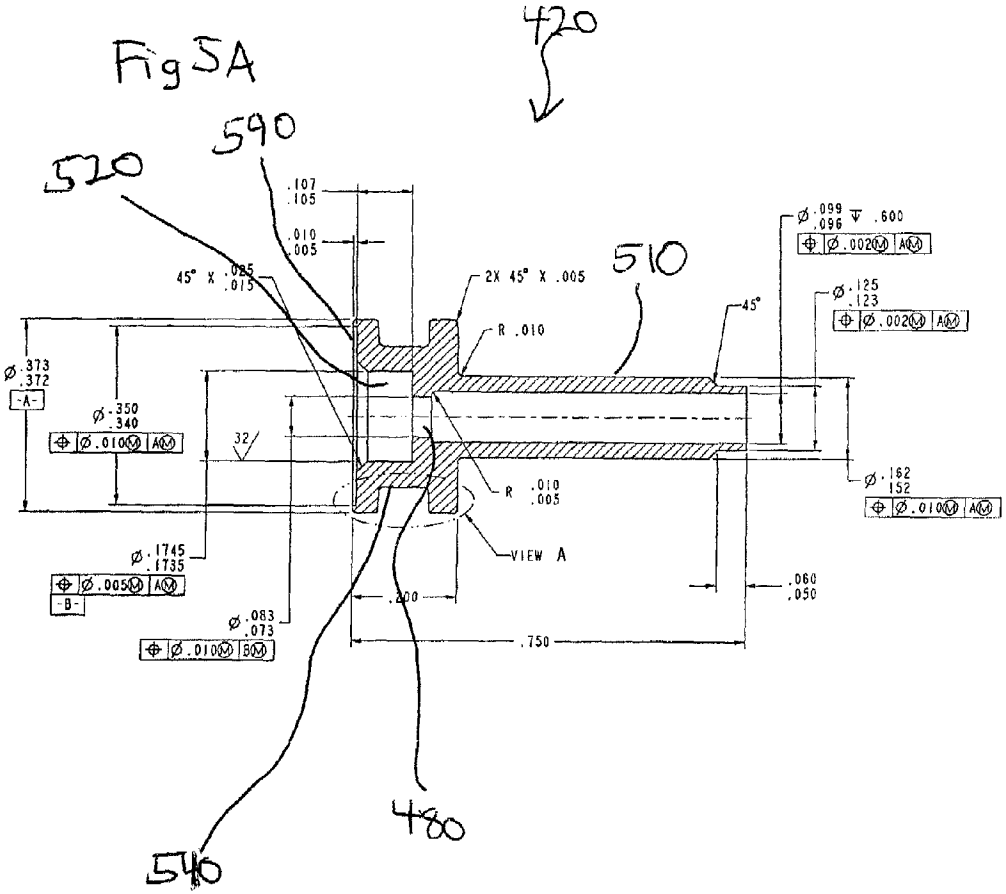

FIG. 5A illustrates a cross-sectional view of the ferrule 420 used in end fitting 400 having percussion primer 460. Portion 510 of ferrule 420 is crimped to the transfer line 300 when installed. Percussion primer void 520 holds the percussion primer 460 and is covered by closure disk 490. Through hole 480 is disposed about center line of ferrule 420 and connects percussion primer 460 with RDC 100 enabling transfer of ignition energy from end fitting 400 to transfer line 300. Circular recess 590 of ferrule 420 accommodates a closure cap 490. FIG. 5B is a close-up view of the portion of ferrule 420 that contains the O-ring 450 when assembled. Annular groove 540 being preferably 0.095 inches wide hosts annular O-ring 450 when fully assembled as in FIG. 4.

Figure 6B:
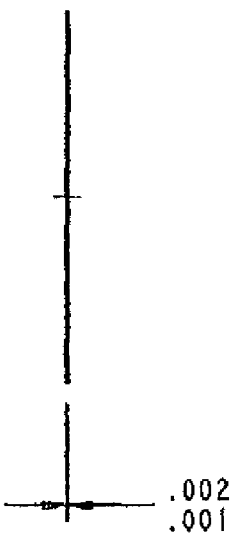
FIGS. 6A and 6B are views of the closure disk illustrated in FIG. 4 that is used in percussion primer end fittings according to an embodiment of the present invention.
Figure 6A:
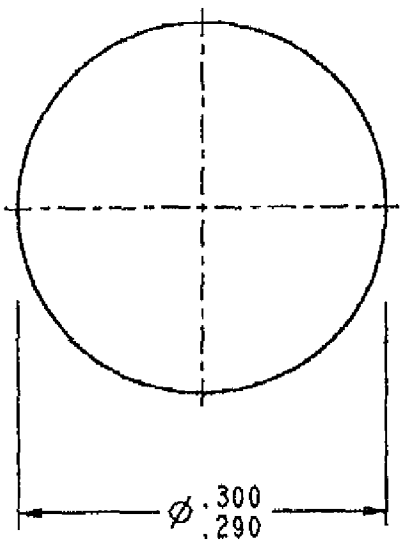

FIG. 6A illustrates a view of closure cap 490 employed in end fitting 400 of FIG. 4. Closure cap is preferably circular and preferably has a diameter of 0.295 inches and is preferably made of stainless steel and covers percussion primer void 520 of ferrule 420 enabling a percussion primer 460 to reside therein. FIG. 6B illustrates a side view of closure cap 490. Closure cap 490 is very thin and has a thickness of 0.001 to 0.002 inches.

Figure 7B:
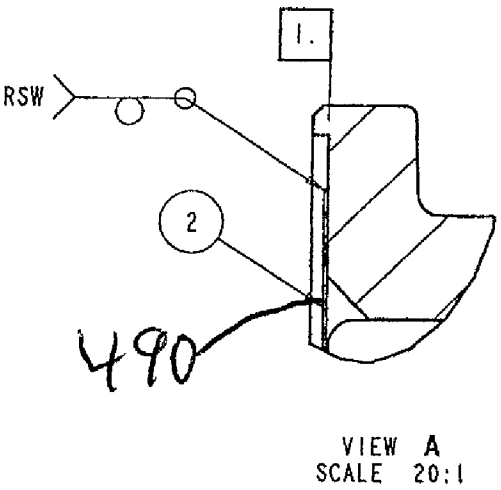
FIGS. 7A and 7B are cross-sectional views of the partially assembled percussion primer end fitting illustrated in FIG. 4 according to the principles of the present invention.
Figure 7A:
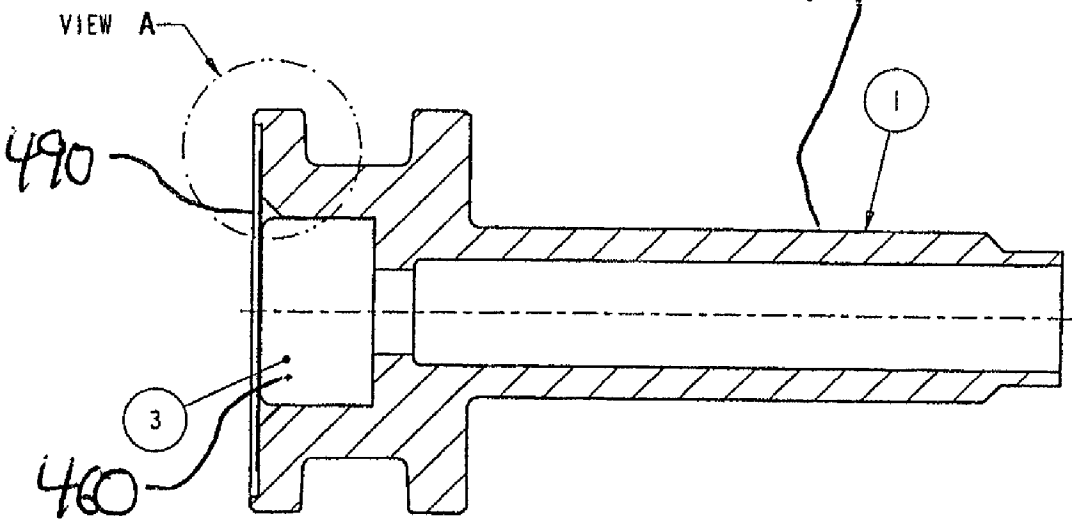

FIG. 7A illustrates closure cap 490 of FIGS. 6A and 6B connected to ferrule 420 illustrated in FIG. 5A to create an enclosed percussion primer void 520 behind closure cap 490 which contains the percussion primer 460. Thus, FIG. 7A is FIG. 4 partially assembled. FIG. 7B illustrates a close-up view of how closure disk 490 attaches to circular recess 590 of ferrule 420 to enable a firing pin to strike the closure cap 490 and ignite powders stored in percussion primer 460 when assembled.

Figure 8A:
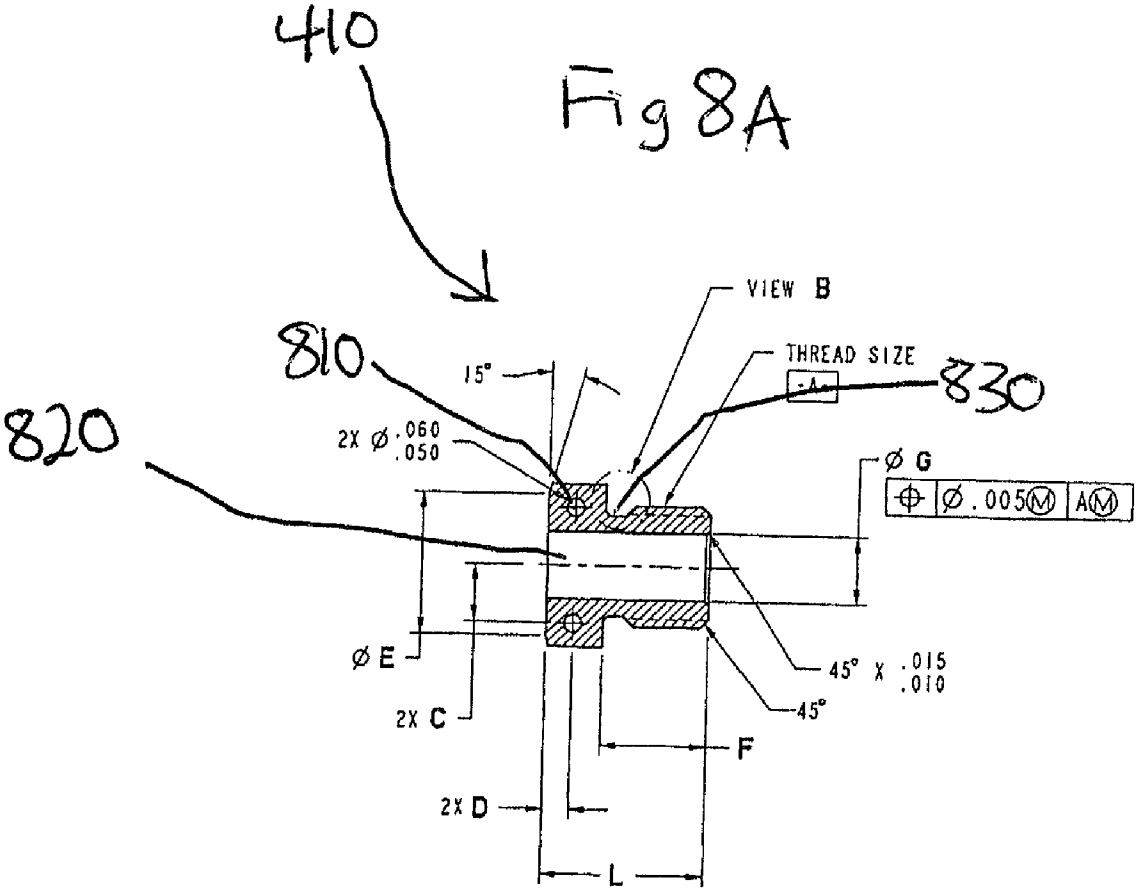
FIG. 8 is a cross-sectional view of a B-nut used in the percussion primer end fitting of FIG. 4 and a LE end fitting of FIG. 10 according to the principles of the present invention.
Figure 8B:
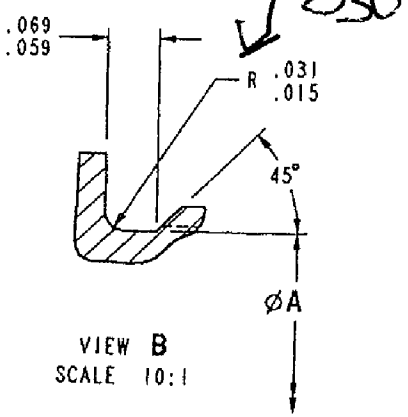

FIG. 8A illustrates the B-nut 410 used in percussion primer end fitting 400 of FIG. 4. Nuts 810 hold end fitting 400 and transfer line 300 in place. Ferrule 420 passes through void 820 of B-nut 410 along the central axis. FIG. 8B is a close-up view of a thin portion 830 of the B-nut illustrating preferred dimensions for holding end fitting 400 and transfer line 300 in place in a transfer manifold.

Figure 9:
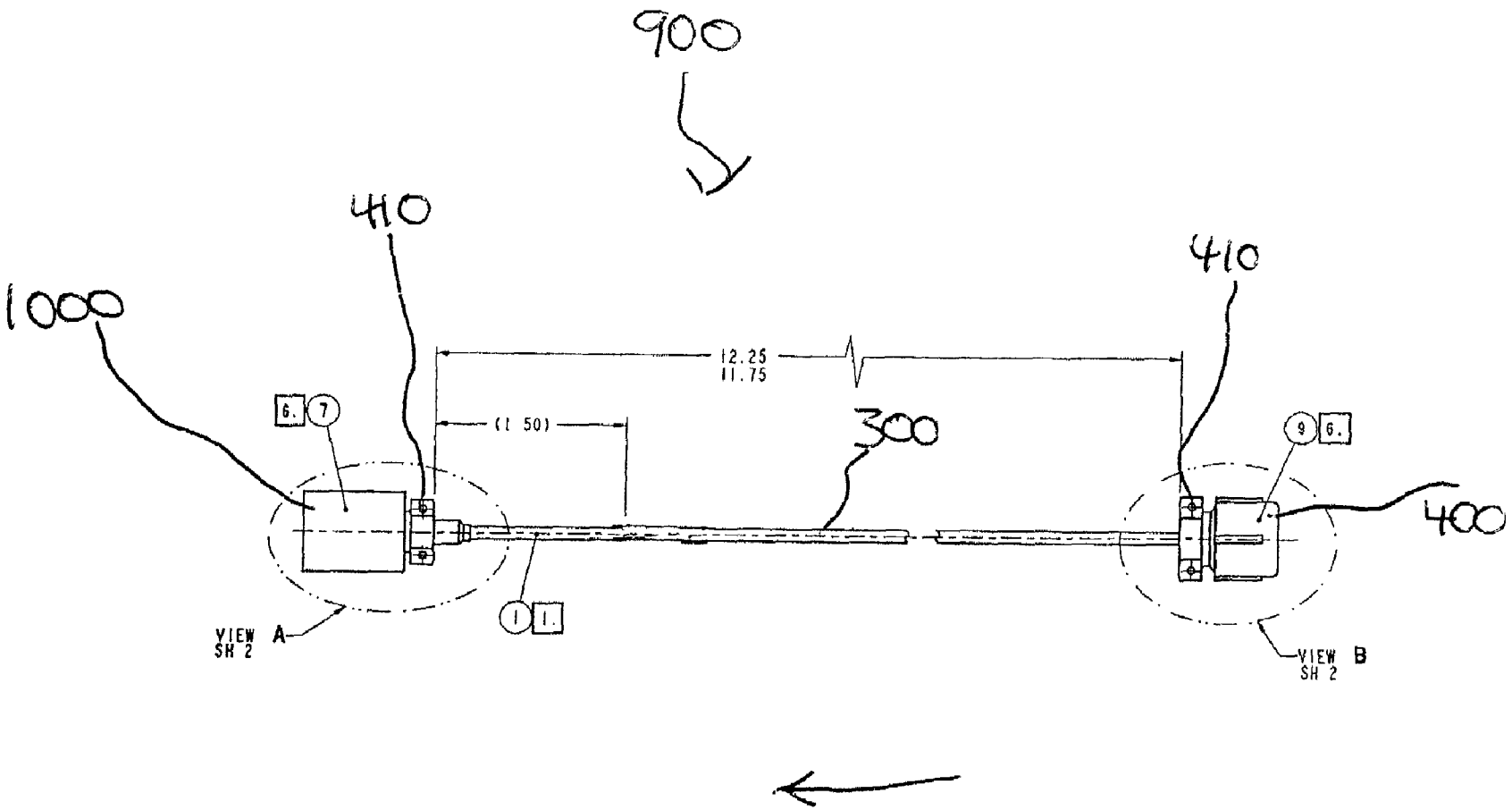
FIG. 9 illustrates the ordnance transfer line of FIG. 3 joining a percussion primer end fitting illustrated in FIG. 4 with the loaded LE end fitting of FIG. 10 according to the principles of the present invention.

FIG. 9 illustrates one possible use for a percussion primer end fitting 400. FIG. 9 illustrates a loaded LE end fitting 1000 connected to a percussion primer end fitting 400 via transfer line 300. The length of the transfer line 300 may vary from a few inches to thousands of feet. Energy is transferred from percussion primer end fitting 400, along transfer line 300 containing RDC 100 having RDM 110 to a loaded LE end fitting 1000. It is to be appreciated that the RDC 100, the percussion primer 460 and the booster charge in the LE end fitting 1000 are hermetically sealed from moisture from the outside during shelflife and do not expel gases when properly functioned in a next assembly protecting persons and objects near assembly 900. It is also to be appreciated that transfer line 300 is designed to be semi-flexible enabling insertion of loaded LE end fitting 1000 into a fixed transfer manifold and insertion of percussion primer end fitting 400 into a fixed arm fire handle receptacle.

Figure 10:
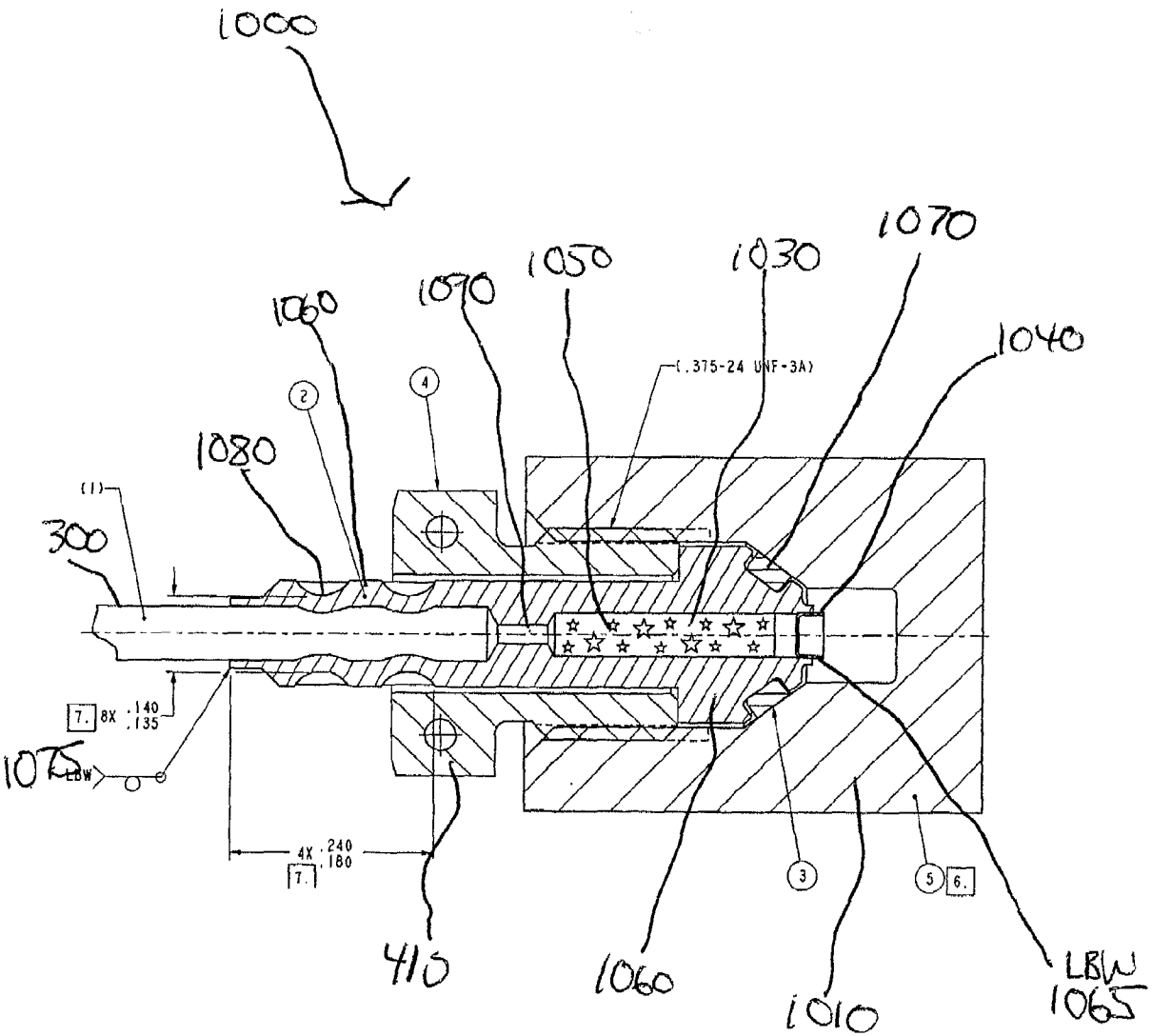
FIG. 10 is a cross-sectional view of a loaded LE end fitting according to the principles of the present invention.

FIG. 10 illustrates a cross-sectional view of a loaded LE end fitting 1000 used in FIG. 9. According to an embodiment of the present invention, the loaded LE end fitting uses essentially the same B-nut 410 as is used in the percussion primer end fitting illustrated in FIG. 4. B-nut 410 is used to secure end fitting 500 into a transfer manifold or some other device. End cap 1010 serves to protect the end fitting 1000 during transportation, and is therefore removed prior to use. Closure cup 1040 is used to hermetically seal the end fitting by laser beam welding a rim of closure cup 540 to an adjacent end of ferrule 1060. Ferrule 1060 and closure cup 1040 are preferably made of stainless steel. A separate reference numeral is given to laser beam weld 1065 between the closure cup 1040 and ferrule 1060 during a laser beam welding process. In this particular laser beam weld 1065, molten stainless steel from ferrule 1060 is mixed with molten stainless steel from closure cup 1040. The laser beam welding 1065 also serves as a donor of steel to the weld 1065 to fortify the weld. It is also noted that closure cup 1040 does not contain the LE booster charge 1050. Instead, the exterior bottom side of closure cup 1040 faces booster charge 1050 and the rim of closure cup 1040 is pointed away from booster charge 1050. A low energy booster charge 1050 is disposed inside void 1030 in ferrule 1060. Booster charge 1050 can be a fuel such as $Cs_2B_{12}H_{12}$mixed with an oxidizer such as $KNO_3$ and is sometimes referred to as a Rapid Deflagration Material (RDM). Ferrule 1060 is specially designed for LE end fittings and serves to bind the transfer line 300 to the booster charge 1050 and the closure cup 1040. It can be appreciated that the ferrule 1060 for LE end fittings has a different design than ferrule 420 used in percussion primers. An annular seal 1070 is placed on an outer side of ferrule 1060 to maintain a hermetic seal between the transfer line 300 and the next assembly by preventing the escaping of gases produced during functioning of the end fitting. Annular seal 1070 is preferably made of Silicone rubber. As in the case of percussion primers, the ferrule 1060 extends around the end of the transfer line 300 and crimps 1080 are used to pinch ferrule 1060 into tubing 200 and into RDC 100 so that the transfer line 300 remains firmly attached to the LE end fitting. Furthermore, the transfer line end of ferrule 1060 is welded, preferrably by a laser beam weld 1075 to the outer portion of tubing 200 to keep ferrule 1060 joined to tubing 200 before, during and after ignition of the booster charge 1050 and to facilitate forming a hermetic seal before, during and after ignition of booster charge 1050 by preventing moisture from entering the system prior to functioning and to prevent the escape of gaseous byproducts after functioning. Ferrule 1060 is perforated by a spit hole 1090 disposed on a center line of ferrule 1060 enabling the end of RDC 100 to energize booster 1050 inside void 1030 to blow apart closure cup 1040 or to allow booster charge 1050 to start the burning of RDC 100 in the case that the reaction progresses from right to left. Spit hole 1090 serves to restrict the back flow of gases produced in the burning of RDC 100 or booster charge 1050, depending on the direction of the reaction. It can be appreciated that after removal of end cap 1010, LE loaded end fitting 1000 may be placed into a transfer manifold or other assemblies with one or more LE end fittings (not shown) to start further reactions. End fitting 1000 may, instead, be inserted into a transfer manifold (to be described later) and be energized by either another loaded LE end fitting or a loaded HE end fitting locked into the same transfer manifold as loaded LE end fitting 1000. Also, a loaded LE end fitting 1000 may be used to trigger some other function such as initiating a pin puller or pressure cartridge to function some other mechanical device. However, in no case may a LE end fitting serve to energize an HE end fitting as LE boosters burn or deflagrate while loaded HE end fittings detonates.

Figure 11:
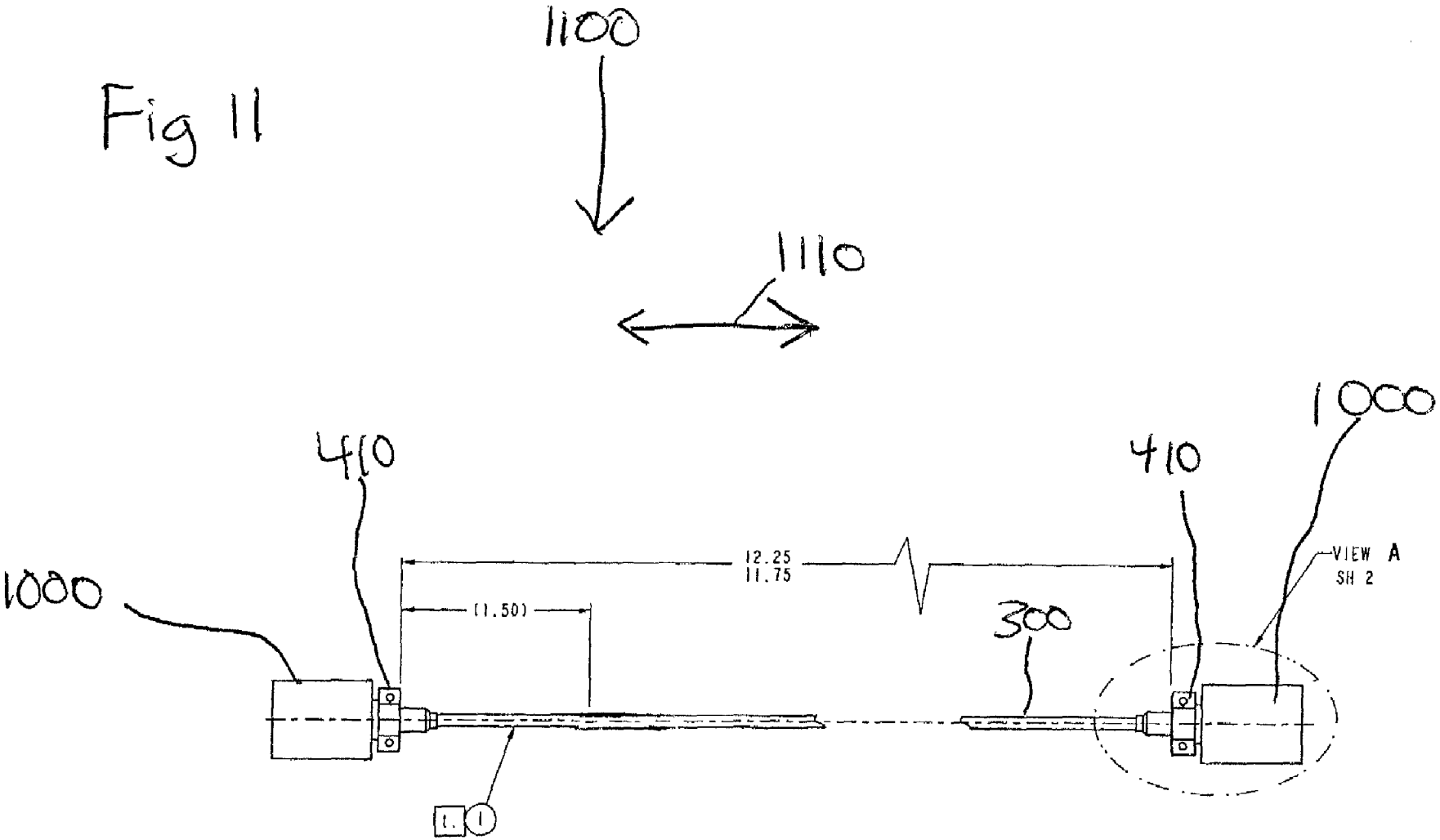
FIG. 11 illustrates the ordnance transfer line of FIG. 3 connecting two loaded LE end fittings like the one illustrated in FIG. 10 according to the principles of the present invention.

FIG. 11 illustrates a transfer line connecting two loaded Low Energy (LE) end fittings 1000. Bidirectional arrow 1110 illustrates that energy can transfer either from right to left or from left to right in the setup 1100 in FIG. 11. The transfer line 300 transfers energy from one loaded LE end fitting 1000 to the other loaded LE end fitting 1000. The length of the transfer line 300 may vary from a few inches to thousands of feet.

Figure 12:
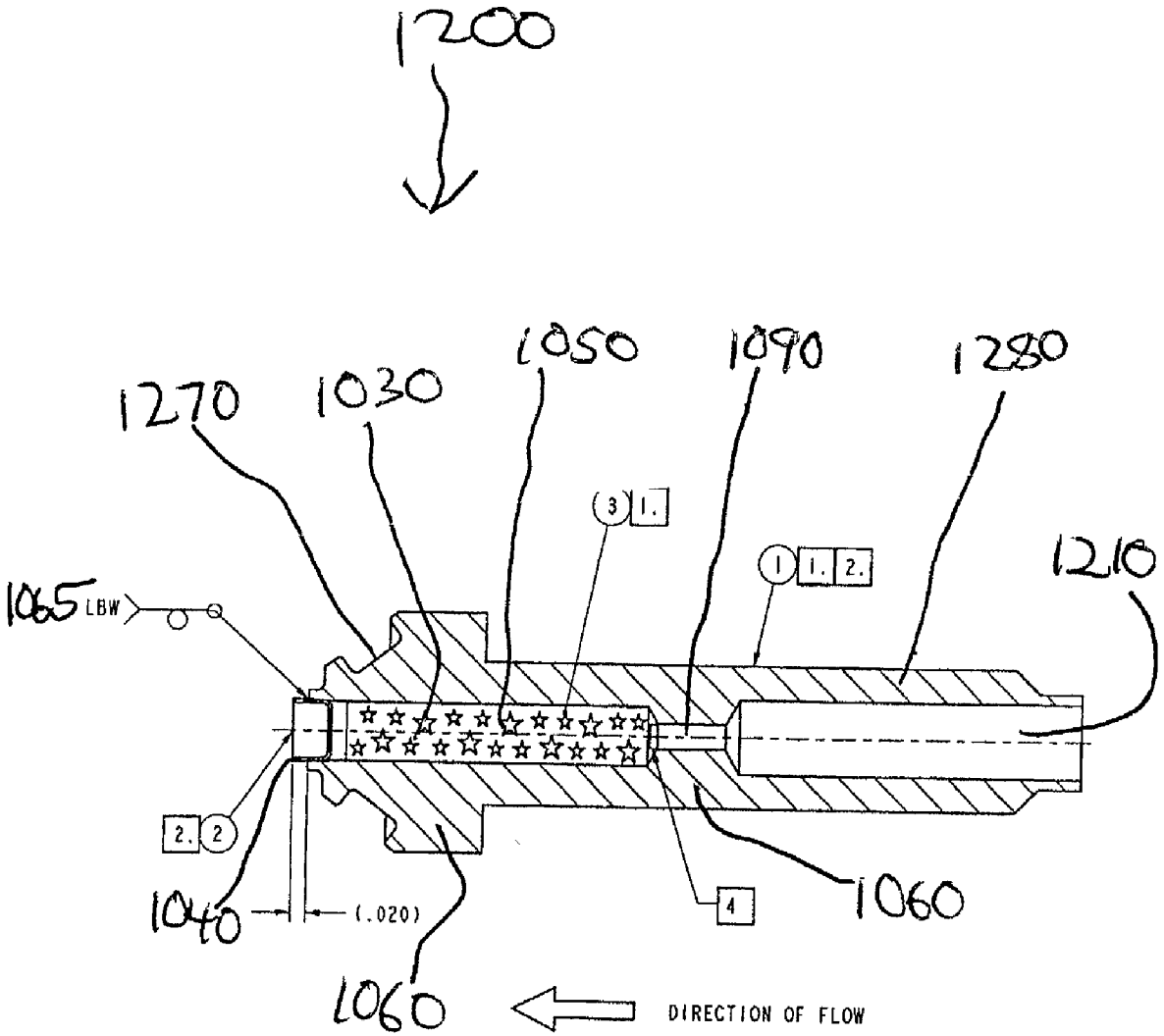
FIG. 12 is a cross-sectional view of a partial assembly of the loaded LE end fitting illustrated in FIG. 10 according to the principles of the present invention.

FIG. 12 illustrates a partial assembly 1200 of the loaded LE end fitting 1000 illustrated in FIG. 10. Ferrule 1060 has two voids 1030 and 1210 connected by a spit hole 1090. Void 1030 is filled with a booster charge 1050 and is sealed by closure cup 1040 LBW 1065 to ferrule 1060. Inside void 1210 is where a transfer line 300 is inserted. Portion 1280 of ferrule 1060 is crimped or staked when a transfer line 300 is inserted into cavity 1210 of ferrule 1060. Annular groove 1270 is where Silicone rubber annular seal 1070 resides when loaded LE end fitting 1000 is fully assembled.

Figures 13A, 13B, 13C:
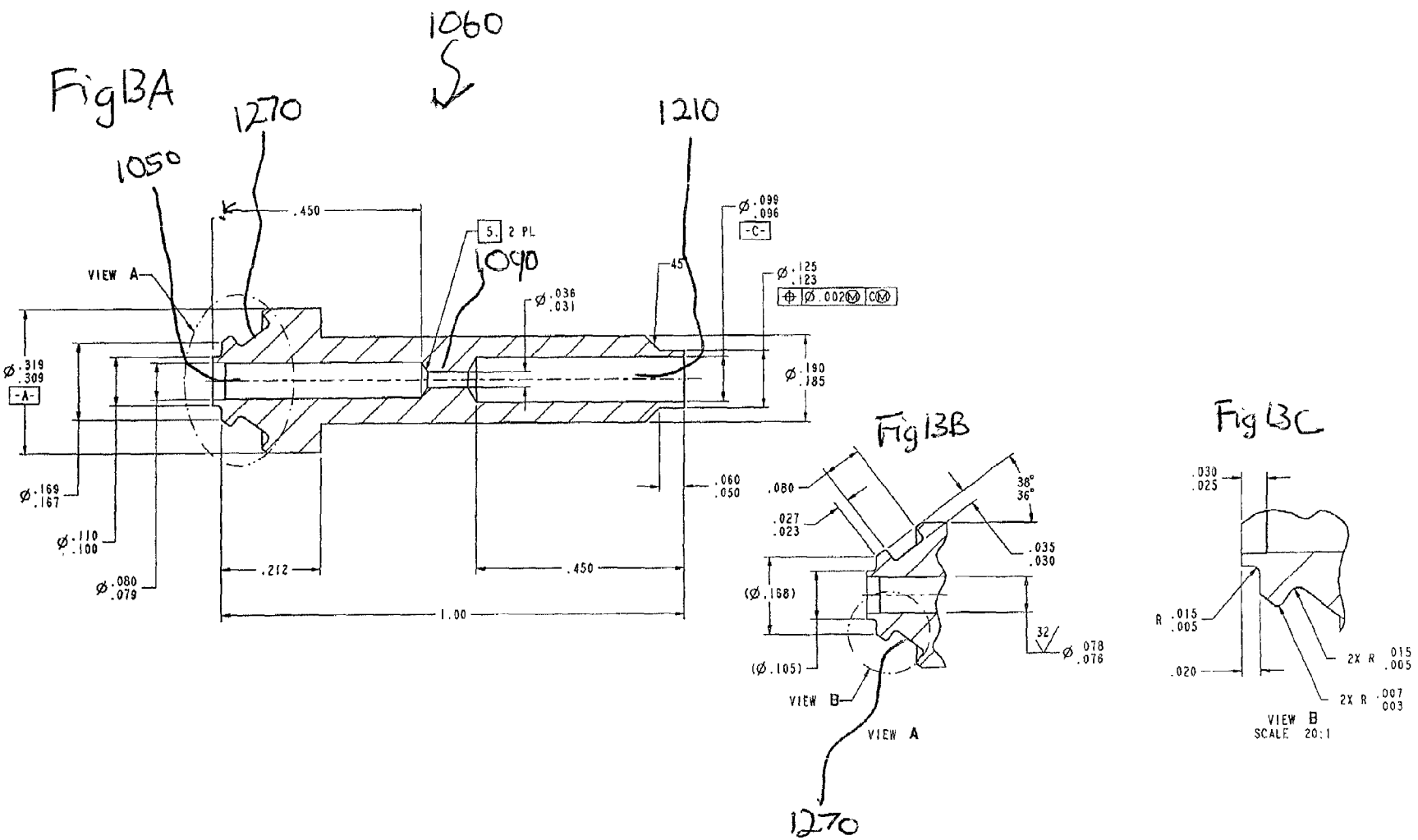
FIGS. 13A-13C are cross-sectional views of the ferrule used in the loaded LE end fitting illustrated in FIG. 10 according to the principles of the present invention.

FIG. 13A illustrates ferrule 1060 used in loaded LE end fittings 1000 like the one illustrated in FIG. 10. The preferred dimensions of ferrule 1060 are illustrated in inches, but by no means is this invention limited to the exact dimensions indicated on FIGS. 13A-13C. Void 1050 has a diameter of 0.080 inches, is annular, and is disposed along the central axis of ferrule 1060. Spit hole has a diameter of 0.033 inches and again is annular and is disposed about the central axis of ferrule 1060. Void 1210 has an inner diameter of 0.098 inches and accommodates a standard transfer line 300 such as the one depicted in FIG. 3. FIG. 13B illustrates a portion of ferrule 1060 near annular groove 1270 where annular Silicone rubber seal 1070 is inserted. This groove is depicted to be 0.080 inches wide. FIG. 13C illustrates a portion of FIG. 13B illustrating the edge of groove 1270 that accommodates annular Silicone rubber seal 1070 when the LE end fitting 1000 is assembled.

Figures 14A, 14B:
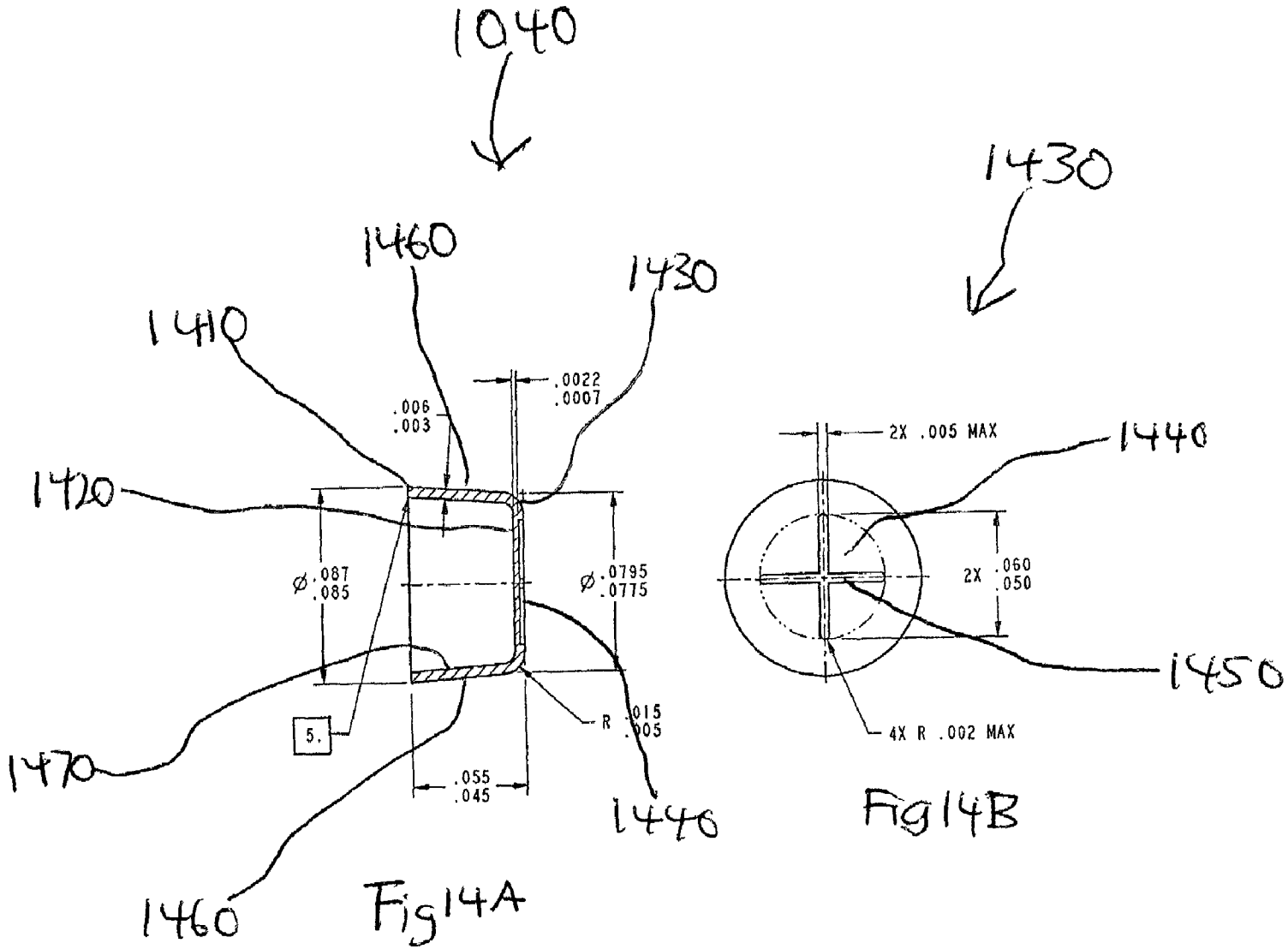
FIGS. 14A and 14B are views of the novel closure cup used in the loaded LE end fitting illustrated in FIGS. 10 and 12 according to the principles of the present invention.

FIGS. 14A and 14B illustrate in detail the closure cup 1040 used in loaded LE end fitting 1000 in FIG. 10. FIG. 14A illustrates a cross-sectional side view of closure cup 1040 while FIG. 14B illustrates an end view of the bottom (the side that faces booster charge 1050) of closure cup. Dimensions of closure cup 1040 illustrated in FIGS. 14A and 14B are the preferred dimensions in inches and in no way restricts the scope of this invention to these exact dimensions. Closure cup 1040 is made of metal, preferably stainless steel. In LE end fitting assemblies, closure cup 1040 has a rim portion 1410 that is welded to extreme end 1255 of ferrule 1060 producing a laser beam weld 1065 fortified with steel. The closure cup 1040 has interior side walls 1470 extending about 0.050 inches from bottom 1420 to rim 1410. Closure cup 1040 has exterior sidewalls 1460 extending about 0.050 inches from bottom 1420 to rim 1410. At the distal end of these sidewalls is rim 1410 of closure cup 1040. Rim 1410 extends beyond portion 1255 of ferrule 1060 and is LBW 1065 to portion 1255 of ferrule 1060. Closure cup 1040 has an interior bottom surface 1420 and an exterior bottom surface 1430 having a diameter of about 0.0785 inches. It is to be appreciated that it is this exterior bottom surface 1430 of closure cup 1040 that faces booster charge 1050 when installed in a loaded LE end fitting 1000.

Exterior bottom surface 1430 of closure cup 1040 has a coined portion 1440 at the center of exterior bottom surface 1430 of closure cup 1040 and having a diameter of about 0.055 inches. Coined portion 1440 includes cross hairs 1450 approximately 0.003 inches wide that are thinner than other portions of the bottom of closure cup 1040. In the best mode, the cross haired portion 1450 in coined portion 1440 of closure cup 1040 has a thickness between 0.0007 and 0.0025 inches while the thickness of other portions of the bottom of closure cup 1040 outside of cross hairs 1450 have a preferred thickness of 0.003 and 0.006 inches. The preferred metal for closure cup 1040 is stainless steel.

Figure 15:
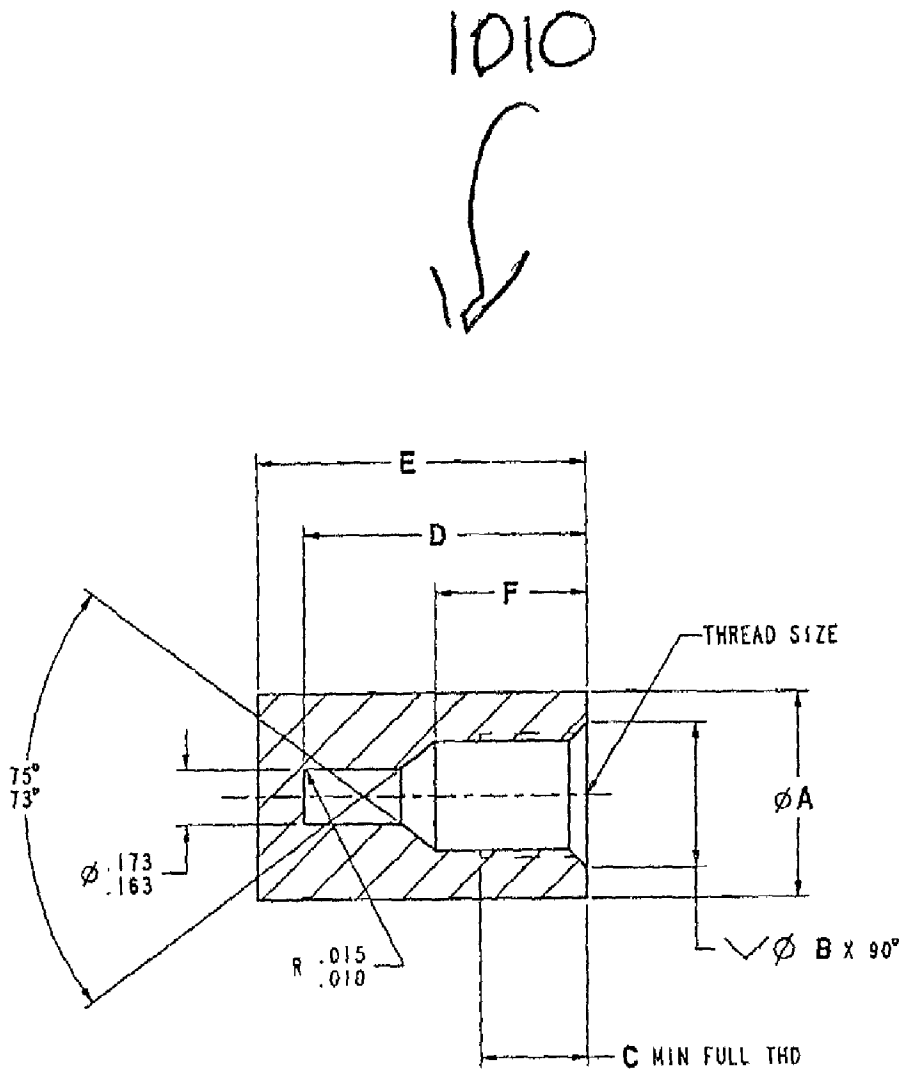
FIG. 15 is a cross-sectional view of the protective plastic cap used in the LE end fitting illustrated in FIG. 10 according to the principles of the present invention.

FIG. 15 illustrates the removable protective plastic cap 1010 indicating the portion facing closure cup 1040 having a diameter of about 0.170 inches. The plastic cap has a diameter of 0.625 inches.

Figure 16B:
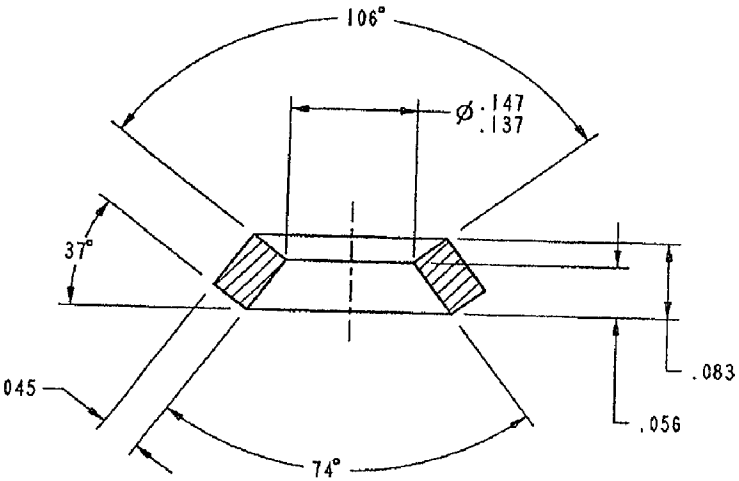
FIG. 16 is a cross-sectional view of the novel seal used in the loaded LE end fitting illustrated in FIG. 10 according to the principles of the present invention.
Figure 16A:
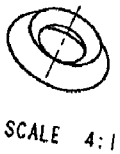

FIGS. 16A and 16B illustrates seal 1070 usually made of Silicone rubber. This seal is disposed in annular groove 1270 of ferrule 1060. Seal 1070 prevents gases produced by the burning of RDM 110 and booster charge 1050 from escaping into the surroundings. FIG. 16A illustrates that seal 1070 is annular in shape while FIG. 16B illustrates the angle of orientation. Annular seal 1070 forms a hermetic seal between ferrule 1060 of loaded LE end fitting 1000 and the transfer manifold loaded LE end fitting is inserted into. Details of the transfer manifold will be discussed later.

Figure 17:
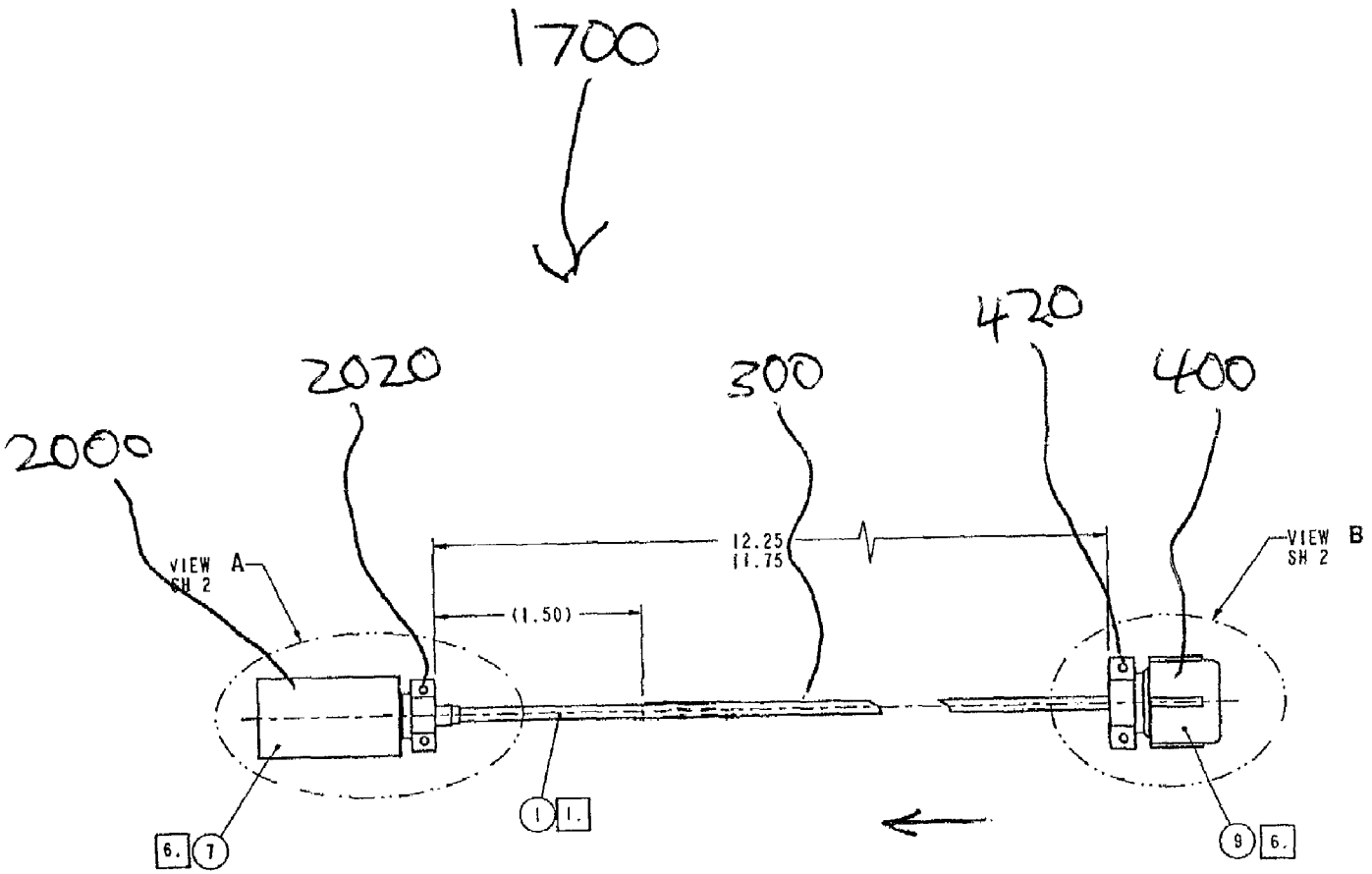
FIG. 17 illustrates the ordnance transfer line illustrated in FIG. 3 connecting the percussion primer end fitting illustrated in FIG. 4 to a standard loaded HE end fitting illustrated in FIG. 20 according to the principles of the present invention.

FIG. 17 illustrates a setup 1700 having a percussion primer end fitting 400 as depicted in FIG. 4 that ignites, burns through transfer line 300 from right to left as indicated by the one-way arrow 1710 to set off a detonation in a standard loaded HE end fitting 2000. As with the setup 900 in FIG. 9, setup 1700 in FIG. 17 requires that the reaction progresses from right to left. The percussion primer end fittings 400 and the transfer lines 300 are identical to those in FIG. 9. However, loaded HE end fitting 2000 uses a separate B-nut 2020 different from the B-nuts 410 used for percussion primer end fittings of FIG. 4 and loaded LE end fittings of FIG. 10. The transfer line can be anywhere from several inches to several thousand feet. It is to be appreciated that percussion primer end fittings 400 are fitted into arm fire handle assemblies while the loaded HE end fitting 2000 may be fitted into a transfer manifold or some other assembly.

Figure 18:
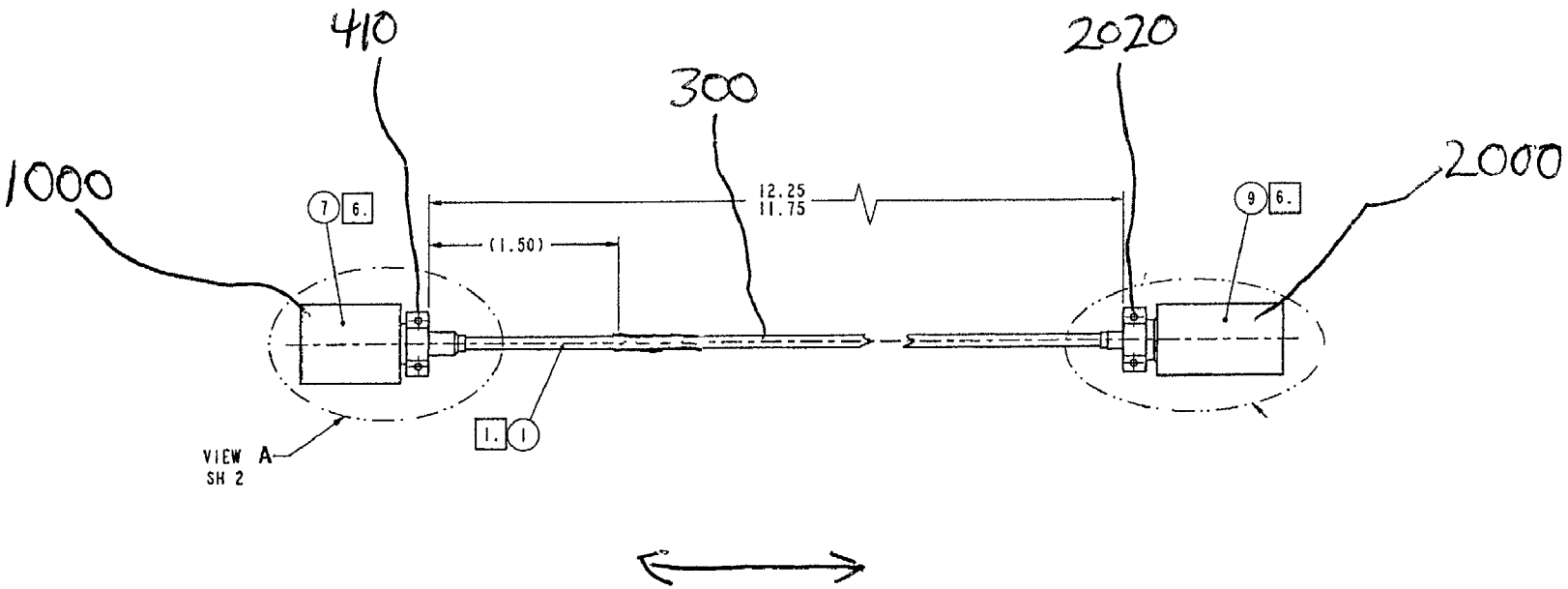
FIG. 18 illustrates the ordnance transfer line illustrated in FIG. 3 connecting the loaded LE fitting of FIG. 10 with a standard loaded HE end fitting illustrated in FIG. 20 according to the principles of the present invention.

FIG. 18 illustrates a transfer line 300 connecting a loaded LE end fitting such as 1000 in FIG. 10 to a standard loaded HE end fitting 2000. Again, transfer line 300 may be from a few inches to several thousand feet. Loaded LE end fitting may be fitted into a transfer manifold or may be used for other purposes. Similarly, loaded HE end fitting 2000 may be fitted into a transfer manifold or be used in some other assembly. It is to be appreciated that, like the setup 1700 in FIG. 17, the setup 1800 in FIG. 18 uses a semi-flexible transfer line 300 enabling an installer to bend slightly transfer line 300 to install the end fittings into fixed assemblies. Bidirectional arrow 1810 indicates that the reaction may proceed from right to left or from left to right.

Figure 19:
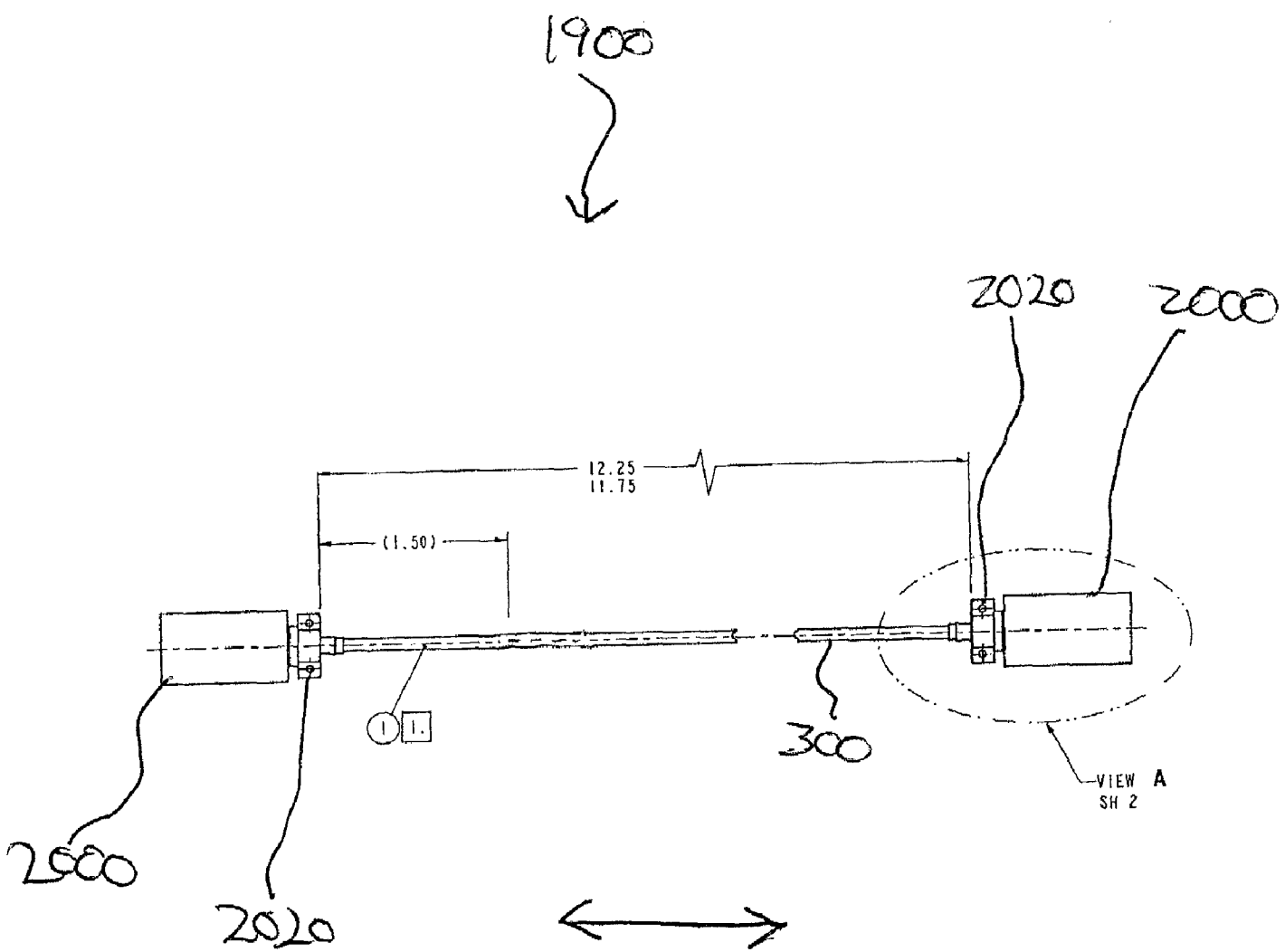
FIG. 19 illustrates the ordnance transfer line illustrated in FIG. 3 connecting two standard loaded HE end fittings illustrated in FIG. 20 according to the principles of the present invention.

FIG. 19 illustrates an arrangement 1900 where a transfer line 300 connects a pair of standard loaded HE end fittings 2000. As indicated by the bidirectional arrow 1910, the reaction can proceed from right to left or from left to right. It is to be understood that upon installation, the protective covers are removed from the end fittings and the end fittings are installed into transfer manifolds or other assemblies to accomplish a task.

Figure 20:
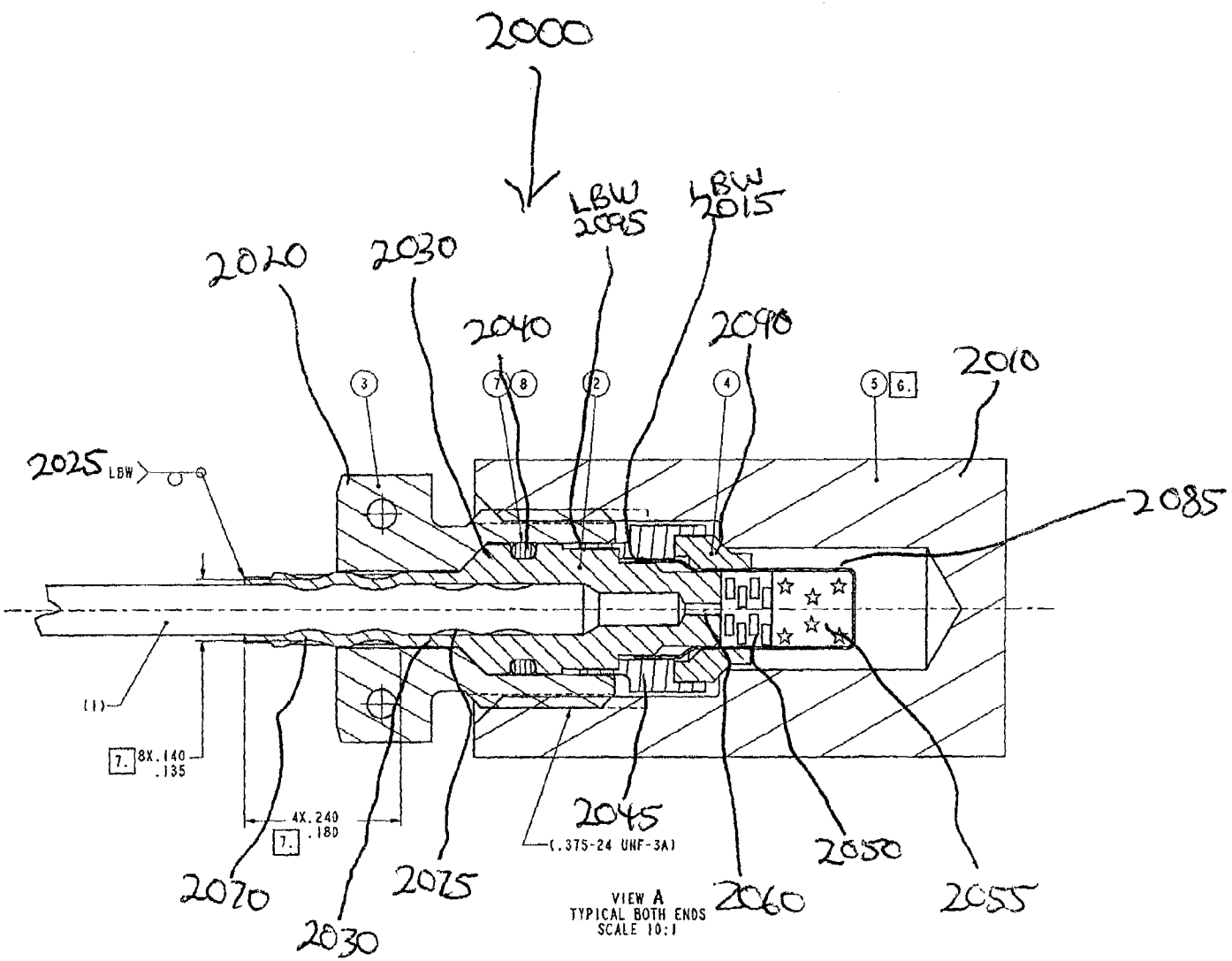
FIG. 20 illustrates a cross-sectional view of a standard loaded HE end fitting according to the principles of the present invention.

FIG. 20 illustrates a cross-sectional view of a standard loaded HE end fitting 2000 such as the ones depicted in FIGS. 17-19. Aluminum cap 2010 used to protect elements in the HE end fitting 2000 from damage during shelflife and transport. Cap 2010 is removed prior to installation of an end fitting into a transfer manifold or some other assembly immediately prior to use of end fitting 2000. B-nut 2020 is used to secure a standard loaded HE end fitting 2000 into place. Ferrule 2030, preferably made of stainless steel, is used to physically join together transfer line 300 to HE end fitting 2000 while maintaining a hermetic seal within transfer line 300 and inside the loaded HE end fitting 2000. It must be appreciated that the ferrule 2030 used for an HE end fitting is designed differently than the ferrule 1060 used in LE end fittings or the ferrule 420 used in the percussion primer. For example, ferrule 2030 has an annular groove used to accommodate a Silicone Rubber O-ring that doesn't have the angular slant that seal 1070 has in loaded LE end fitting 1000 of FIG. 10. Spit hole 2060 joins RDC 100 with a Lead Azide ($Pb_2N_3O_2$) 2050 booster charge used to step up the reaction from deflagration (or burning) to detonation. Detonation propagates a shock wave at a speed that exceeds the bum rate of deflagration. The Lead Azide booster charge 2050 is disposed between spit hole 2060 and the HE detonation charge 2055 located within closure cup 2085. It must also be appreciated that the design and the implementation of closure cup 2085 is vastly different from the design and implementation of closure cup 1040 used in LE end fittings 1000. Unlike closure cup 1040, closure cup 2085, preferably made of stainless steel, is orientated opposite to that of closure cup 1040 so that closure cup 2085 serves to surround the HNS detonation charge 2055 along with the Lead Azide booster charge 2050. The HE detonation charge is Hexa Nitro Stilebene (HNS) which is an industry standard detonation charge. A seal 2090 forms an annular shape and is disposed around ferrule 2030 near the spit hole 2060 and the Lead Azide booster 2050. The seal 2090 is preferably a special Silicone Rubber seal but a copper seal has also been known to be used. Seal 2090 prevents the escape of gases during and after when end fitting 2000 functions. A stainless steel interface retainer 2045 forms an annular shape and is disposed around ferrule 2030 between O-ring 2040 and the special Silicone Rubber seal 2090. The rim of stainless steel interface retainer 2045 is welded, preferably by a laser beam weld 2095 to the exterior of ferrule 2030. The rim of closure cup 2085 is welded, preferably by laser beam weld 2015 to an outside annular surface of ferrule 2030 directly underneath annular stainless steel retainer 2045. Both weldings serve to provide a hermetic seal for the HINS charge 2055, the Lead Azide booster charge 2050 and the RDC 100 so that these parts 1) remain moisture free during the shelflife and 2) no gases escape upon burning of RDC 100, burning of the Lead Azide booster charge 2050 and the detonation of the HNS 2055. Like other ferrules, ferrule 2030 has crimping (or staking) 2070 in the portion of the ferrule 2030 where RDC 100 and metal tubing 200 of transfer line 300 are inserted into to firmly attach the HE end fitting 2000 to the transfer line 300. Further crimping 2075 is performed on tubing 200 on the HNS detonation charge 2055 side of crimpings 2070. In addition, ferrule 2030 is laser beam welded at 2025 to the exterior of transfer line 300 to further bind ferrule 2030 to metal tubing 200 and to create the hermetic seal that keeps moisture out during a shelflife and prevents gases from escaping during and after functioning. As can be appreciated, the reaction in FIG. 20 can move from right to left and have the detonation set off another one or plurality of loaded LE or HE end fittings fitted into a proper transfer manifold as end fitting 2000 or the reaction can pass from left to right where another HE fitting fitted within the same transfer manifold as end fitting 2000 detonates causing the FINS 2050 disposed in end fitting 2000 to detonate causing RDC 100 to bum from left to right.

Figure 21:
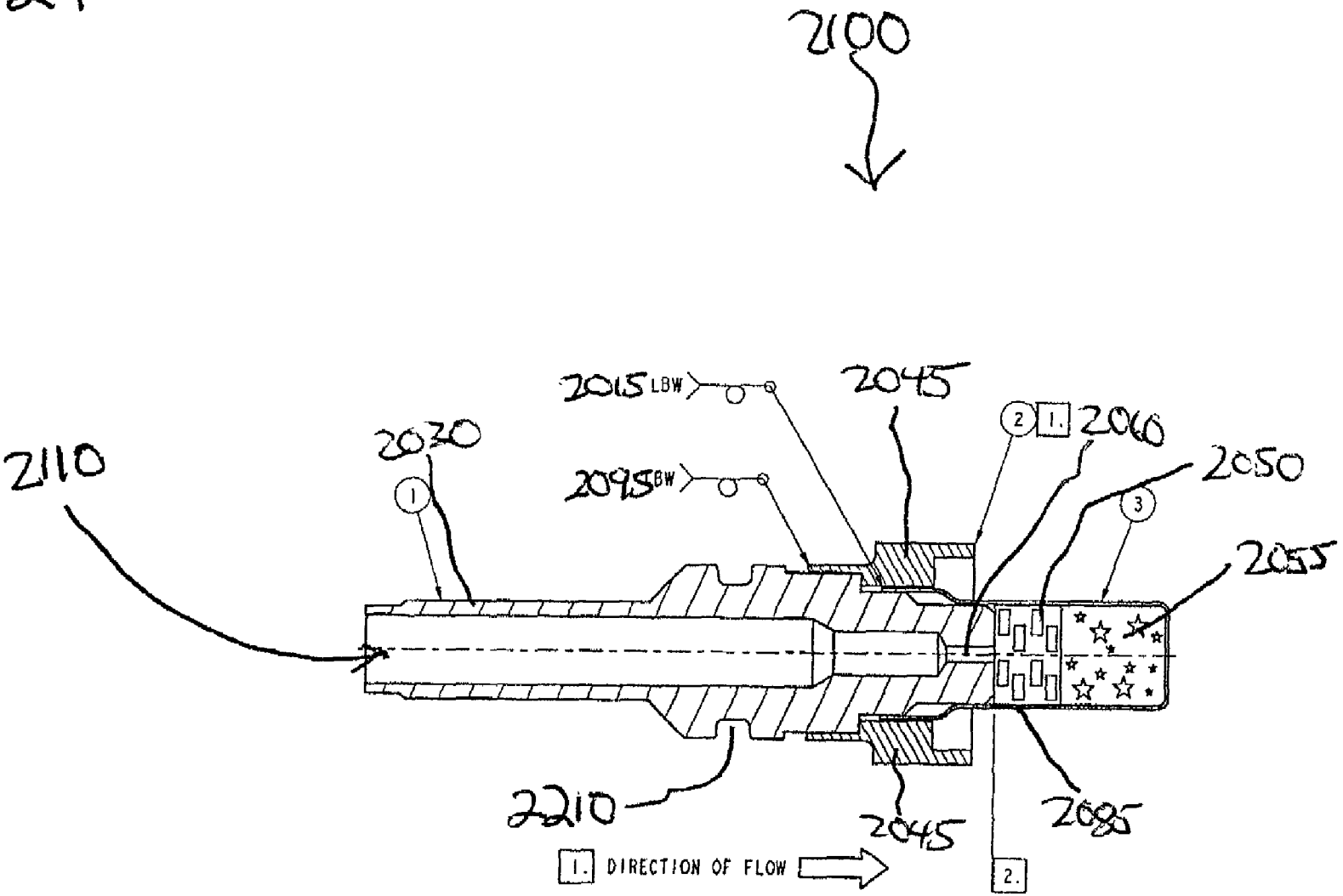
FIG. 21 illustrates a cross-sectional view of a partial assembly of the loaded HE end fitting illustrated in FIG. 20 according to the principles of the present invention.

FIG. 21 is a partial assembly 2100 of a standard loaded HE end fitting 2000 illustrated in FIG. 20 wherein selected parts are removed to emphasize LBW 2015, LBW 2095 and stainless steel retainer 2045. LBW 2095 illustrates stainless steel retainer 2045 LBW to ferrule 2030. LBW 2015 illustrates closure cup 2085 welded to ferrule 2030 underneath stainless steel retainer 2045. Cavity 2110 is formed where a standard transfer line 300 is ordinarily fitted and LBW 2025. Also, crimpings 2070 are absent because transfer line 300 is not yet inserted into cavity 2110 of ferrule 2030 of assembly 2100 of FIG. 21.

Figure 22B:
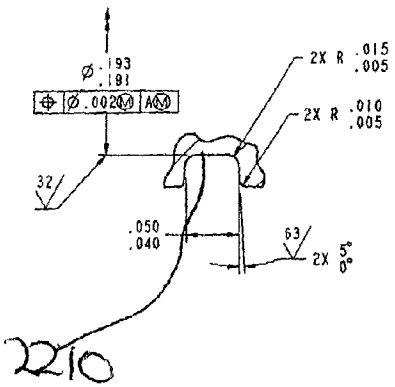
FIGS. 22A and 22B are cross-sectional views of the ferrule used in the standard loaded HE end fitting illustrated in FIG. 20 according to the principles of the present invention.
Figure 22A:
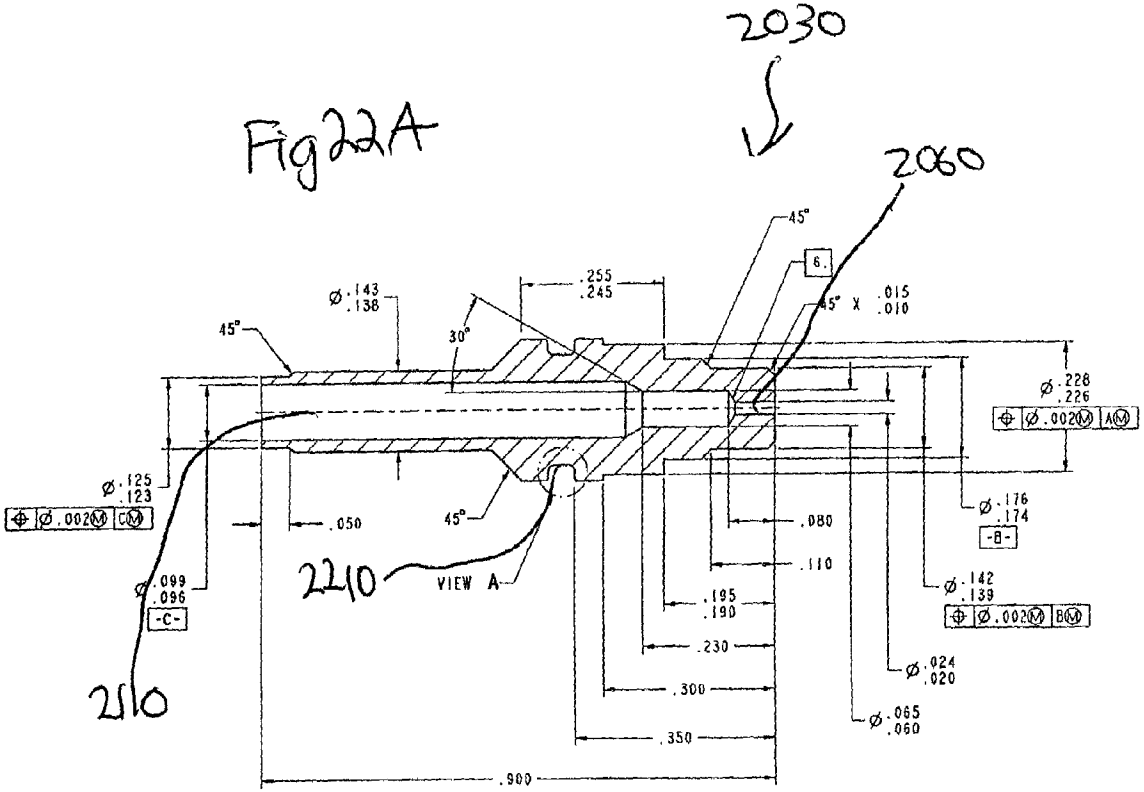

FIGS. 22A and 22B illustrate ferrule 2030 used for standard loaded HE end fittings like the one illustrated in FIG. 20. FIG. 22A illustrates the dimensions of each portion of the ferrule 2030 in inches in the preferred embodiment. It is to be understood that this invention is not restricted in scope to the exact measurements illustrated in FIGS. 22A and 22B. Of importance is the inner diameter of void 2110 that accommodates transfer line 300. The inner diameter of void 2110 is about 0.098 inches in this embodiment. The spit hole has a diameter of about 0.022 inches. Annular groove 2210 accommodates Silicone rubber O-ring 2040. This groove is illustrated in FIG. 22B as being about 0.045 inches wide.

Figure 23:
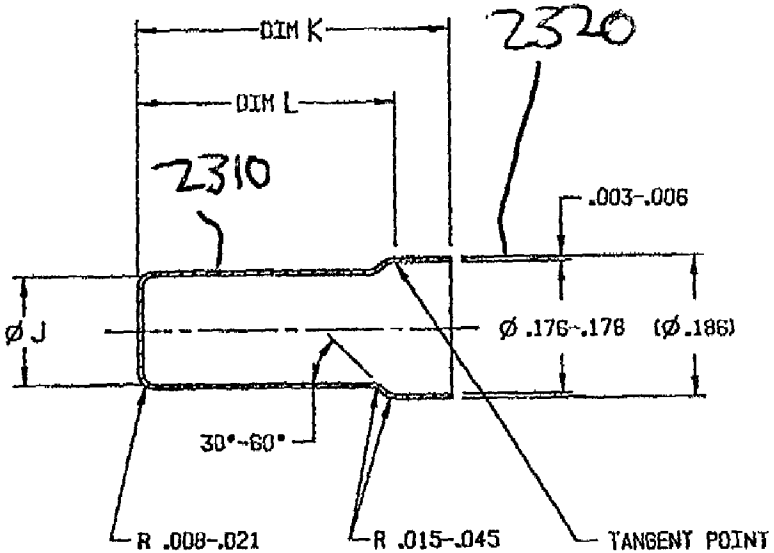
FIG. 23 illustrates a cross-sectional view of the closure cup used in the standard loaded HE end fitting illustrated in FIGS. 20 and 21 according to the principles of the present invention.

FIG. 23 illustrates the closure cup 2085 used in loaded HE end fittings. In the preferred embodiment, the closure cup 2085 is made of stainless steel and has a thickness of about 0.005 inches. This closure cup 2085 explodes upon detonation of charge 2055. The closure cup has a small diameter portion 2310 and a large diameter portion 2320. Small diameter portion 2310 contains the Lead Azide booster 2050 and the HNS detonation charge 2055 when loaded. Closure cup 2085 is LBW 2015 between the wide diameter 2320 of closure cup 2085 and the ferrule 2030 underneath stainless steel retainer 2045.

Figure 24:
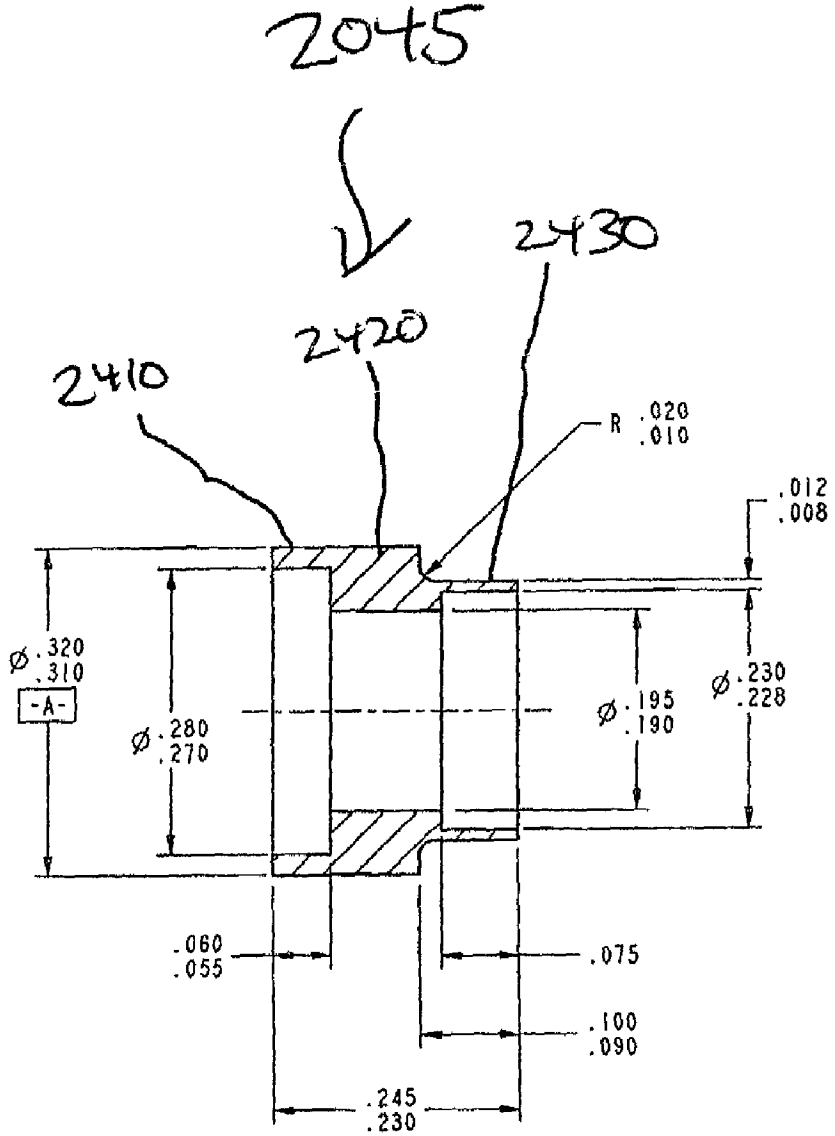
FIG. 24 illustrates a cross-sectional view of the stainless steel retainer used in the standard loaded HE end fitting illustrated in FIGS. 20 and 21 according to the principles of the present invention.

FIG. 24 illustrates the stainless steel retainer 2045 used in the loaded HE end fitting 2000 of FIG. 20. Stainless steel retainer 2045 can be broken up into 3 portions, each being annular and each having a different diameter. Although FIG. 24 illustrates specific dimensions of stainless steel retainer 2045, in no way is it to be inferred that this invention is restricted only to those dimensions illustrated. Left portion 2410 has an inner diameter of 0.275 inches and an outer diameter of 0.315 inches. Portion 2410 of retainer 2045 is LBW 2095 to an outer surface of ferrule 2030. Middle portion 2420 of retainer 2045 has an inner diameter of 0.192 inches and an outer diameter of 0.315 inches and is used to pinch wide diameter portion 2320 of closure cup 2085 to ferrule 2030 so that wide diameter portion 2320 of closure cup 2085 can be LBW 2015 to an outer surface of ferrule 2030. Right portion 2430 of retainer 2045 has an inner diameter of 0.229 inches and an outer diameter of 0.250 inches and serves to pinch seal 2090 onto the outer surface of ferrule 2030 near where the booster charge 2050 and the detonation charge 2055 are located.

Figure 25B:
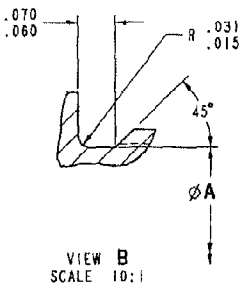
FIGS. 25A-25C is a cross-sectional view of the B-nut used in the standard loaded HE end fitting illustrated in FIG. 20 according to the principles of the present invention.
Figure 25C:
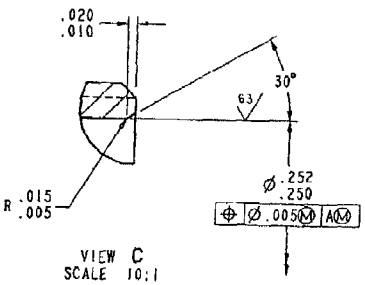
Figure 25A:
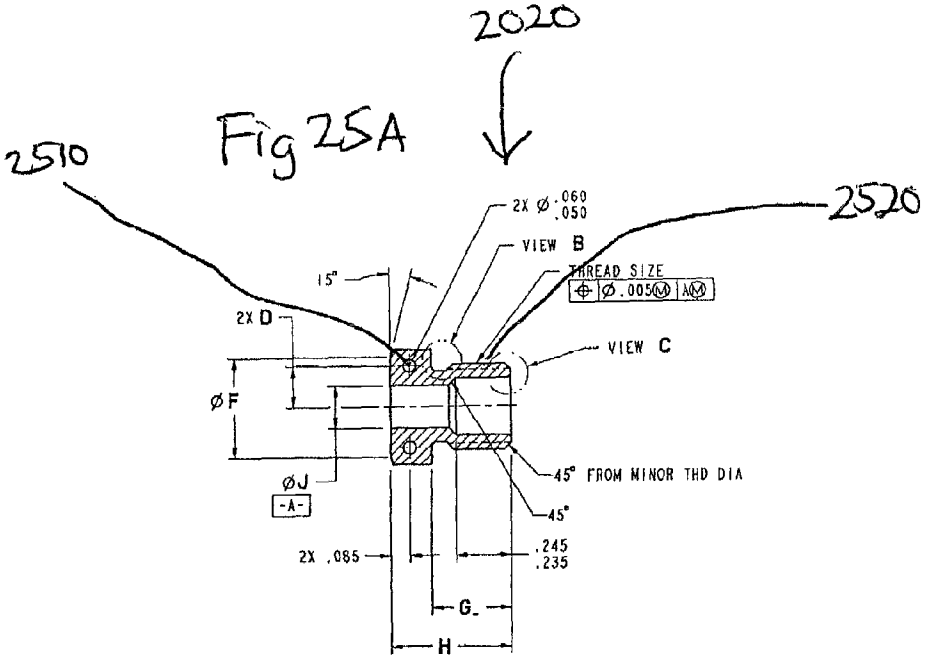

FIGS. 25A-25C illustrate a detailed view of the B-nut 2020 used in the loaded HE end fitting 2000 illustrated in FIG. 20. FIG. 25B illustrates a portion of the B-nut between the bolting 2510 and the sleeve portion 2520. Sleeve portion 2520 of B-nut 2020 covers O-ring 2040 and left portion 2410 of retainer 2045. FIG. 25C illustrates the tapering at the extreme right most portion of sleeve 2520 of B-nut 2020.

Figures 26A, 26B, 26C, 26D:
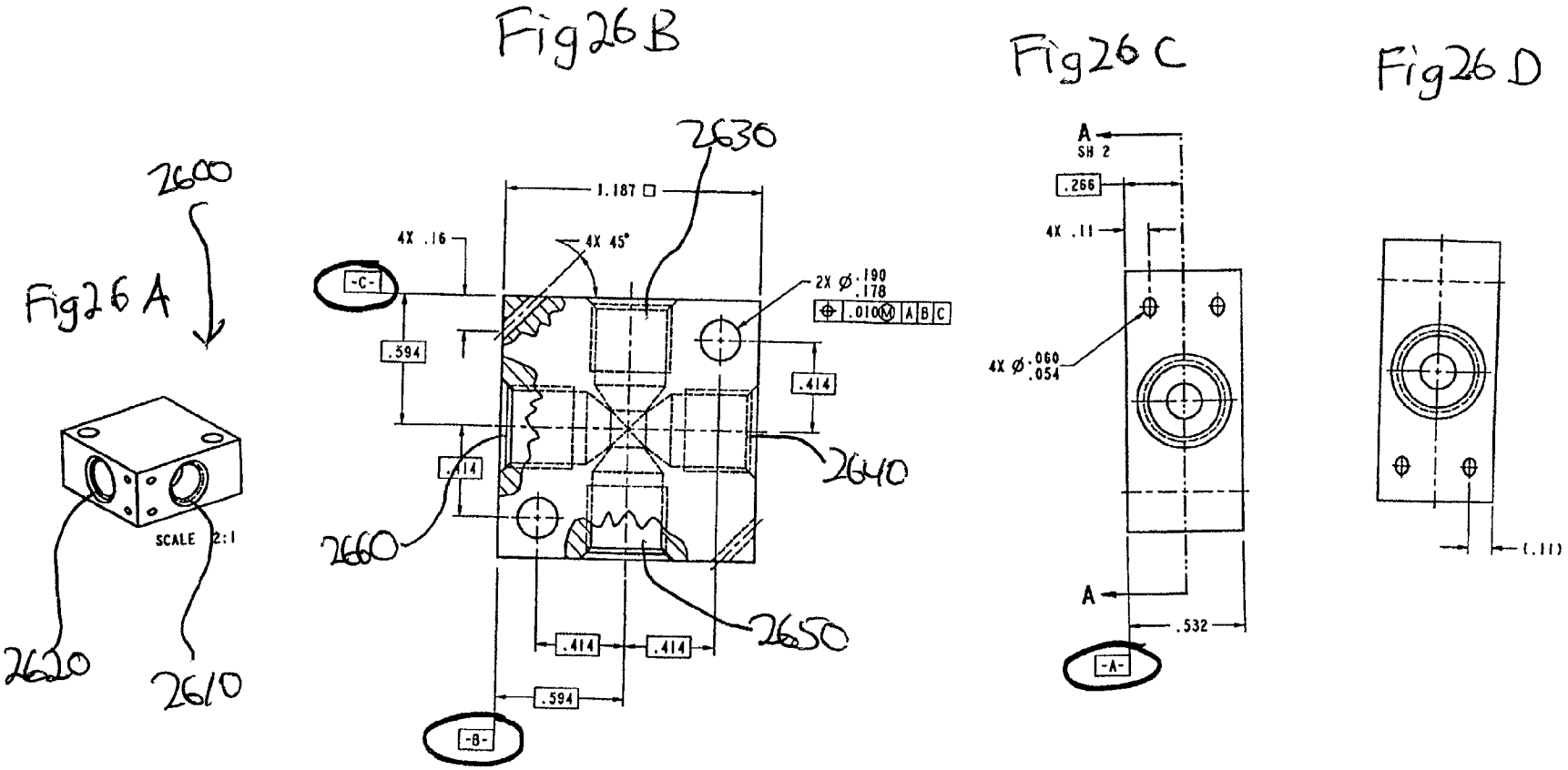
FIG. 26A illustrates a plan view of a 4 port transfer manifold into which the loaded LE end fitting such as those illustrated in FIG. 10 may be fitted into according to the principles of the present invention.
FIGS. 26B-26D illustrates cross-sectional views of the 4port transfer manifold of FIG. 26A according to the principles of the present invention.

FIGS. 26A-26D illustrate different views of a 4 port transfer manifold that could be employed to house loaded LE end fittings 1000 according to an embodiment of the present invention. In such a 4 port manifold, a reaction enters in one of the 4 ports, and if all 4 ports are loaded, the one incoming reaction could set off 3 reactions which can then be simultaneously sent along 3 separate transfer lines to another end fitting. FIG. 26A is a plan view of such a 4 port manifold 2600. In FIG. 26A, two sockets 2602 and 2604 can house loaded LE end fittings 1000. It is to be understood that when an end fitting is fitted within a socket of a transfer manifold, annular seals disposed around the end fittings form a hermetic seal preventing the escape of unwanted gases when deflagration or detonation occur. FIG. 26B illustrates a cross-sectional view of the 4 port transfer manifold. There are 4 ports (or sockets) used to house loaded LE end fittings. These 4 ports are illustrated as reference numerals 2606, 2608, 2610 and 2612. If a reaction enters the 4 port transfer manifold 2600, a loaded LE end fitting such as that illustrated in FIG. 10 will react with all remaining ports, each containing loaded LE end fittings causing the deflagration to spread in three directions simultaneously. FIGS. 26C and 26D are side views of a particular port used to accommodate loaded LE end fitting to propagate energy along another transfer line. It is to be understood that the transfer manifold 2600 illustrated in FIG. 26 can only allow loaded LE end fittings to attach to it.

Figure 26G:
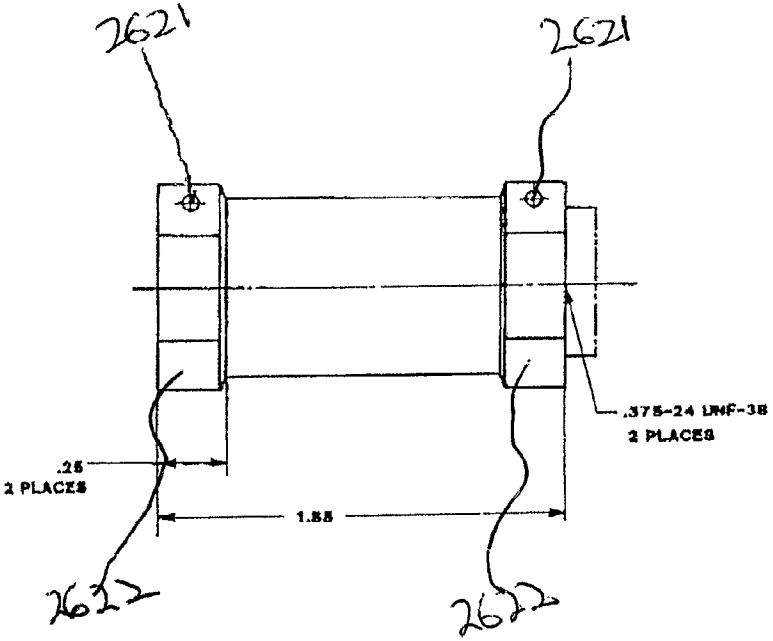
FIGS. 26F and 26G illustrates cross-sectional views of the 2 port transfer manifold of FIG. 26E according to the principles of the present invention.
Figure 26F:
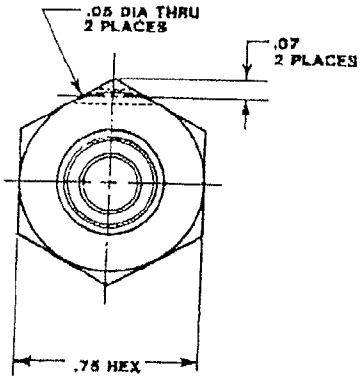
Figure 26E:
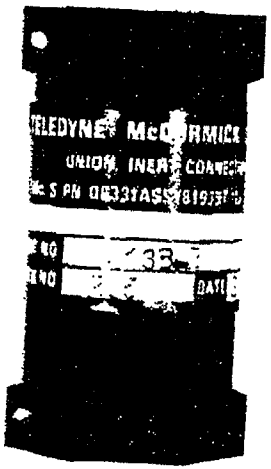
FIG. 26E illustrates a plan view of a two-port transfer manifold that joins together a pair of loaded HE end fittings similar to the loaded HE end fitting illustrated in FIG. 20.

FIGS. 26E-26G illustrates a two-port transfer manifold 2620 into which only loaded HE end fittings may be fitted into. The loaded HE end fittings may be similar to the one illustrated in FIG. 20. The transfer manifold of FIG. 26E weighs approximately 1.3 ounces, is approximately 1.5 inches long and approximately 0.75 inches in diameter. Transfer manifold 2620 is about 1.3 ounces in weight and functions between −80 degrees Fahrenheit to above 475 degrees Fahrenheit, making the transfer manifold 2620 usable in ordnance applications. As illustrated in FIG. 26F, the design of the transfer manifold may be hexagonal rather than perfectly circular. Reinforced edge portions 2622 are 0.25 inches in length. In reinforced edge portions 2622, a lock wire hole 2621 is present. As the both B-nuts and transfer manifold sockets have threads, B-nuts are screwed into the appropriate transfer manifolds. In addition, a copper lock wire is inserted into the lock wire hole 2621 to facilitate attachment of the end fittings to the transfer manifolds. Applications of such a transfer manifold illustrated in FIGS. 26E-26G include interconnecting explosive transfer lines in aircraft or missile systems.

FIGS. 26H-26L illustrate cross-sectional views of a 3-port transfer manifold 2630 specially designed to house and function loaded HE end fittings similar to the loaded HE end fitting 2000 illustrated in FIG. 20. Transfer manifold 2630 has a weight of 2 ounces and can function between −80 to above 475 degrees Fahrenheit, allowing such a manifold to be suitable for ordnance applications. As illustrated in FIG. 26H, sockets that house end fittings have threads 2631 that screw on to threads on the B-nuts to hold the end fittings into the transfer manifolds. In addition, a copper lock wire is also used to secure the end fittings into their appropriate sockets of their appropriate transfer manifolds. As clearly illustrated in FIG. 26L, transfer manifold 2630 includes one input port 2632 and a pair of output ports 2634 and 2636, respectively. Therefore, a single loaded HE end fitting may simultaneously function a pair of loaded HE end fittings using transfer manifold 2630.

Figure 26O:
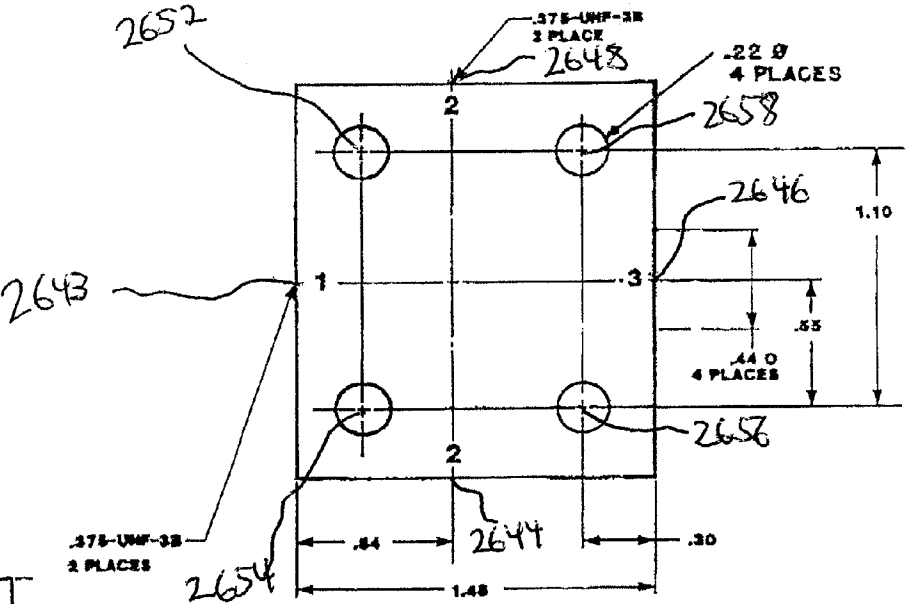
FIGS. 26N and 26O illustrates cross-sectional views of the 4-port transfer manifold illustrated in FIG. 26M into which loaded HE end fittings similar to the loaded HE end fitting illustrated in FIG. 20 may be fitted into.
Figure 26N:
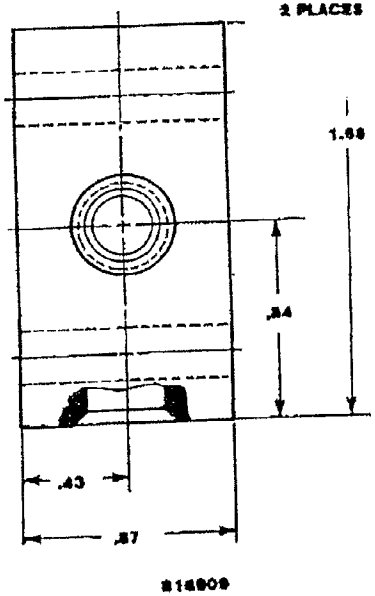
Figure 26M:
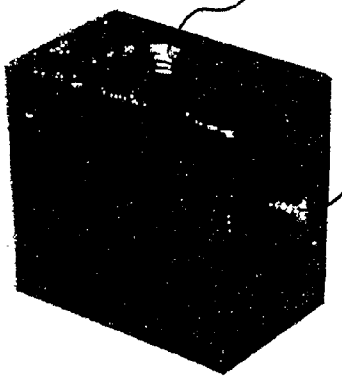
FIG. 26M illustrates a plan view of a 4-port transfer manifold that joins together a 4 loaded HE end fittings similar to the loaded HE end fitting illustrated in FIG. 20.

FIG. 26M illustrates a plan view of a 4-port transfer manifold 2640 used to house and interconnect 4 loaded HE end fittings similar to the ones illustrated in FIG. 20. Transfer manifold 2640 has 4 ports, each of which have threaded sockets illustrated by reference numerals 2641 and 2642. It is to be understood that all transfer manifolds in this invention have sockets with threads enabling a B-nut with threads to be screwed there into attaching an appropriate end fitting to an appropriate transfer manifold. In addition, a copper lock wire is inserted to facilitate the attachment of the end fittings to the transfer manifolds as discussed in the discussion of FIG. 26G. The weight of such a transfer manifold is just under 3 ounces. The operating temperature of transfer manifold 2640 is −65 degrees Fahrenheit to above 475 degrees Fahrenheit making such a transfer manifold suitable for ordnance applications. FIGS. 26N and 26O illustrate cross-sectional views of transfer manifold 2640. As illustrated in FIG. 26O, there is one input port 2643 and 3 output ports 2644, 2646 and 2648, respectively. In addition, FIG. 26O illustrates 4 mounting holes 2652, 2654, 2656 and 2658, respectively. As can be seen from FIGS. 26N and 26O, the preferred dimensions of the 4-port HE transfer manifold 2640 are 1.48 inches by 1.68 inches by 0.87 inches. In no way is this invention restricted to the exact dimensions illustrated in FIGS. 26E-26O. Transfer manifolds that house and join and function both loaded LE end fittings and loaded HE end fittings are well known in the art and the description thereof has been omitted.

Figure 27:
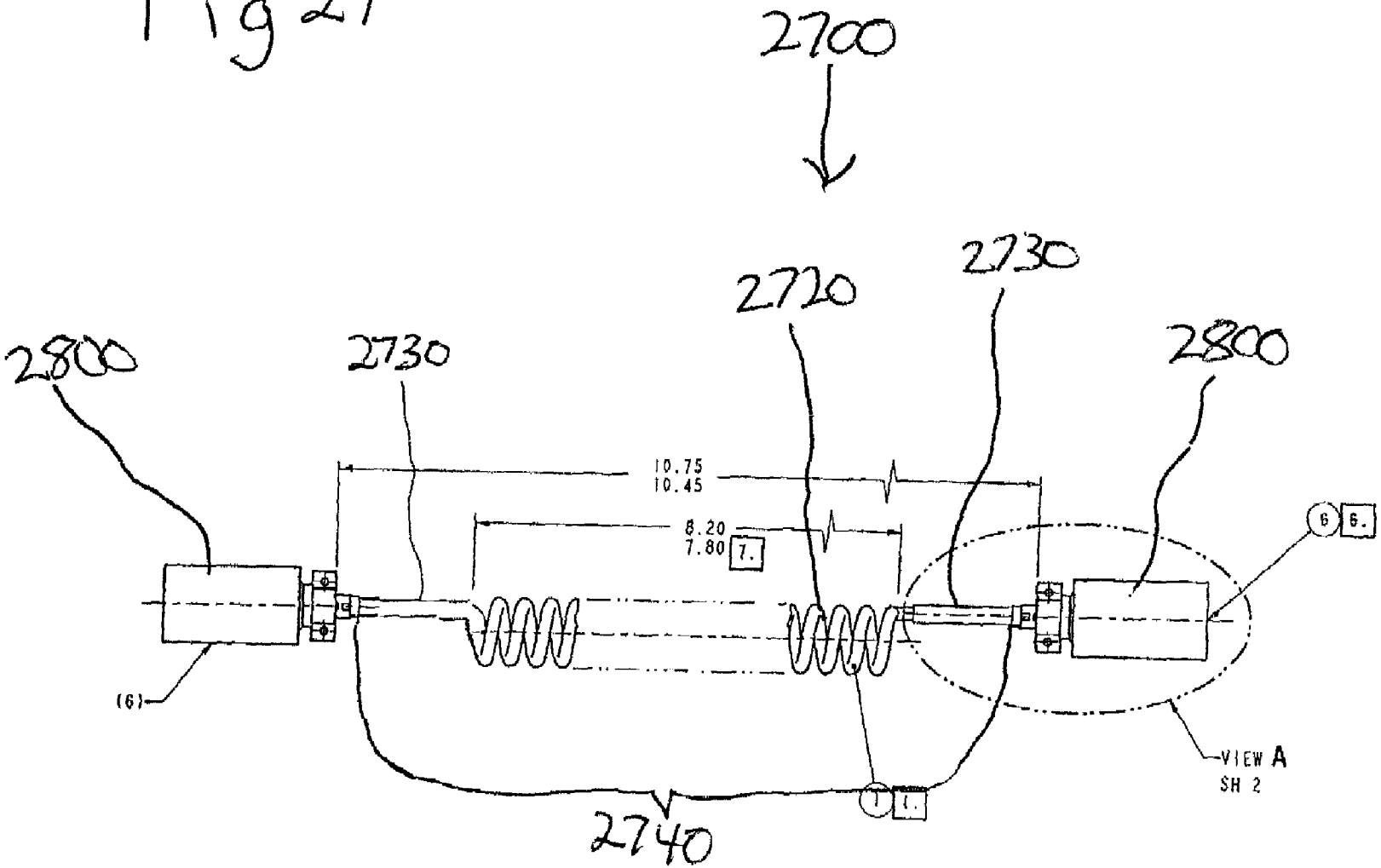
FIG. 27 illustrates a highly flexible ordnance transfer line connecting reinforced loaded HE end fittings illustrated in FIG. 28 according to the principles of the present invention.

FIG. 27 illustrates another embodiment of the present invention. Unlike the setup 1900 of FIG. 19 illustrating a standard transfer line 300 connecting standard loaded HE end fittings 2000 together, the setup 2700 of FIG. 27 illustrates a novel flexible transfer line 2740 having a highly flexible coiled portion 2720 and reinforced end portions 2730 connecting a pair of specially adapted loaded HE end fittings 2800 together. As is clearly illustrated in FIG. 27, the flexible part of the transfer line 2720 is the portion where the transfer line forms a coil. As will be seen in FIG. 31, the end portions 2730 of a flexible transfer line 2740 are constructed differently than transfer line 300 in FIG. 3. As a result, the loaded HE end fittings are slightly different than the standard end fitting 2000 illustrated in FIGS. 20-22B. The modified loaded HE end fitting that attaches to a highly flexible transfer line 2740 is illustrated in FIGS. 27-31. It is to be appreciated that although the design of the transfer line and the end fittings are different in the embodiment illustrated in 2700 using a flexible transfer line, a hermetic seal is still retained before, during and after use. Coil 2720 may be installed into a hinge of a door or hatch. Coil 2720 is strong and sturdy enough to withstand an excess of 50,000 flexes while still maintaining a hermetic seal for the setup 2700 of FIG. 27. Thus, a reaction may be transferred through flexible lines to accomplish a wide variety of functions safely without expelling gases, igniting fires or detonations or absorbing moisture along the transfer lines. Although FIG. 27 illustrates specially designed loaded HE end fittings, it is to be appreciated that a modified loaded LE end fittings as well as a modified percussion primer end fitting can also be used instead of in combination with special loaded HE end fittings 2800 that connect to reinforced end portions 2730 of the highly flexible transfer line 2740.

Figure 28:
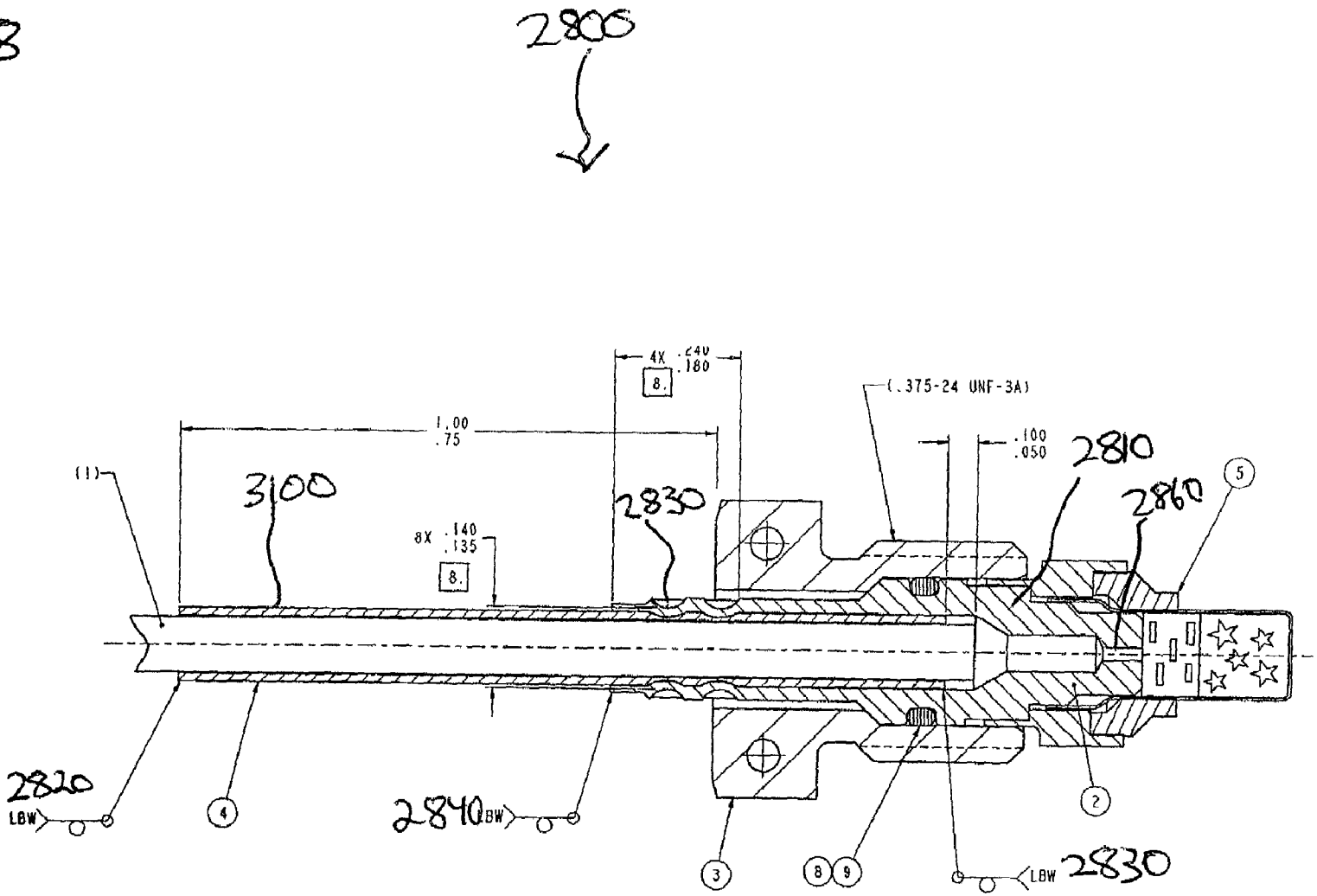
FIG. 28 illustrates a cross-sectional view of a HE end fitting that connects to a reinforced ordnance transfer line that leads to the highly flexible coil illustrated in FIG. 27 according to the principles of the present invention.
Figure 29:
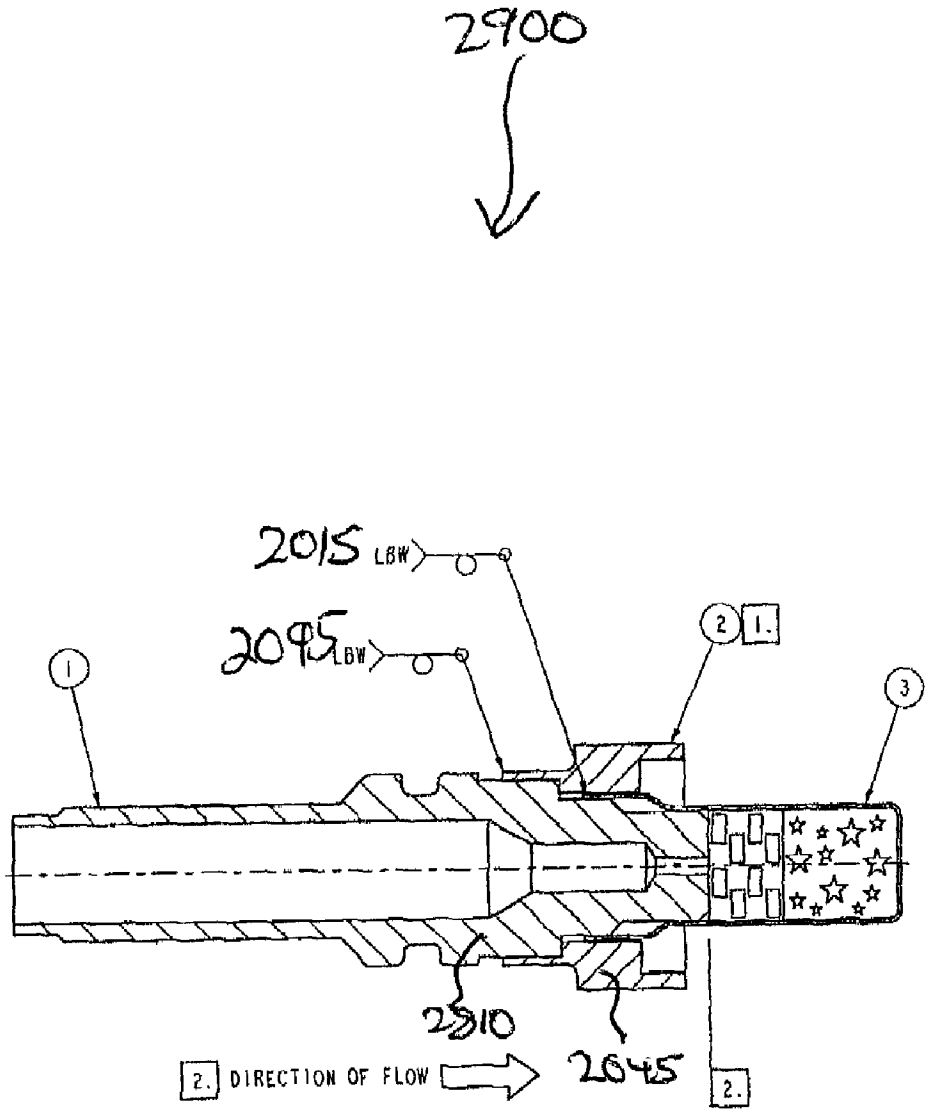
FIG. 29 illustrates a cross-sectional view of a partially assembled loaded HE end fitting illustrated in FIG. 28 that connects to a reinforced ordnance transfer line that connects to a highly flexible coil illustrated in FIG. 27 according to the principles of the present invention.
Figure 30B:
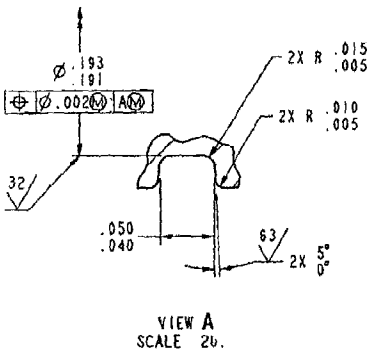
FIGS. 30A and 30B illustrates a cross-sectional view of the ferrule of the HE end fitting of FIG. 28 that connects to a reinforced ordnance transfer line that connects to a highly flexible coil illustrated in FIG. 27 according to the principles of the present invention.
Figure 30A:
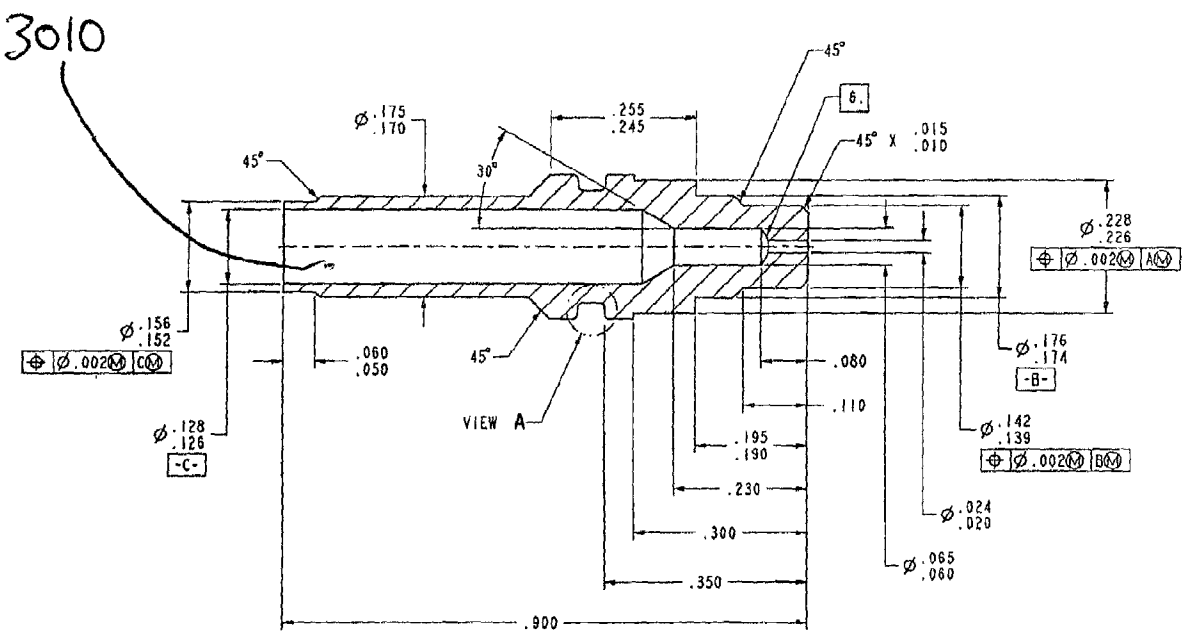
Figure 31:
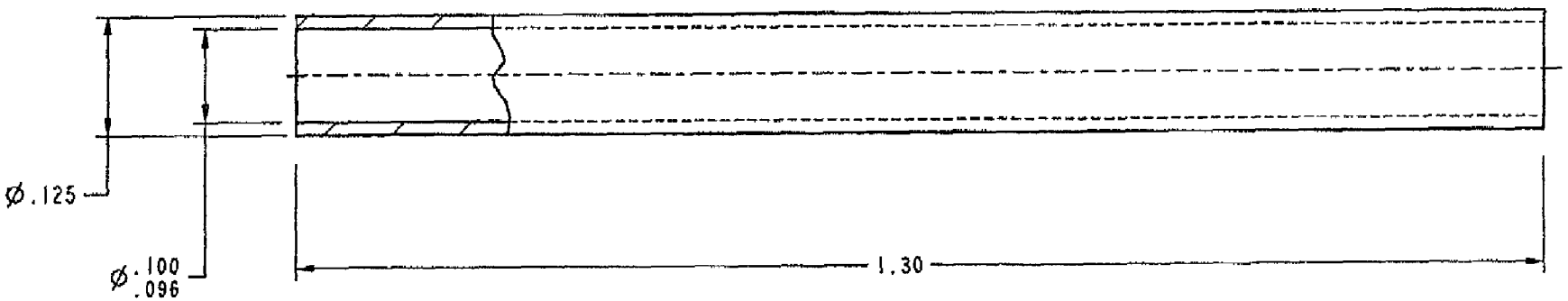
FIG. 31 is a lengthwise cross-sectional view of the reinforced tubing used to fit into the end fitting illustrated in FIG. 28 when the highly flexible ordnance transfer line of FIG. 27 is employed according to the principles of the present invention.

Turning to FIG. 28, FIG. 28 illustrates the special loaded HE end fitting used in the setup 2700 of FIG. 27. Loaded HE end fitting 2800 is similar most respects to the standard loaded HE end fitting 2000 illustrated in FIG. 20 except for the fact that loaded HE end fitting 2800 can accommodate the reinforced tubing end 2730 while the loaded HE end fitting 2000 illustrated in FIG. 20 cannot. In particular, tubing 200 of the transfer line is reinforced at the end fittings of a flex line by a sleeve 3100 illustrated in FIG. 31 having an inner diameter of 0.098 inches and an outer diameter of 0.125 inches. This sleeve 3100 illustrated in FIG. 31, being added to tubing 200 and RDC 100 results in a wider diameter transfer line resulting in ferrule 2810 having a wider opening 3010 than opening 2110 of the ferrule 2030 depicted in FIGS. 20-22B. Opening 3010 of ferrule 2810 has an inner diameter of 0.127 inches as illustrated in FIG. 30A compared to the 0.098 inches for opening 2110 of standard HE ferrule 2030 illustrated in FIG. 22A. In addition, sleeve 3100 is LBW 2820 to tubing 200 of the flexible transfer line 2740. Furthermore, the crimping 2075 of tubing 200 has been eliminated while crimping 2830 between ferrule 2810 and sleeve 3100 is used in place of crimping 2070 in FIG. 20. Since all the other features of FIGS. 27-30B are essentially identical to FIGS. 20-22B, the detailed description has been eliminated. LBW's 2915 and 2995 in FIG. 29 are identical to LBW's 2015 and 2095 in FIG. 20 with the exception that a new ferrule, 2810 instead of 2030 is used, therefore requiring new numbers for the LBW's of FIG. 29. It is also to be appreciated that the arrangement 2700 along with the loaded end fitting 2800, when installed into a transfer manifold like the one depicted in FIGS. 26A-26D provide a hermetic seal to the RDC and to any booster charges and detonation charges prior to, during functioning of, and after functioning of preventing moisture from coming into the system prior to functioning and preventing gaseous byproducts from exiting the system once functioned.

Figure 32:
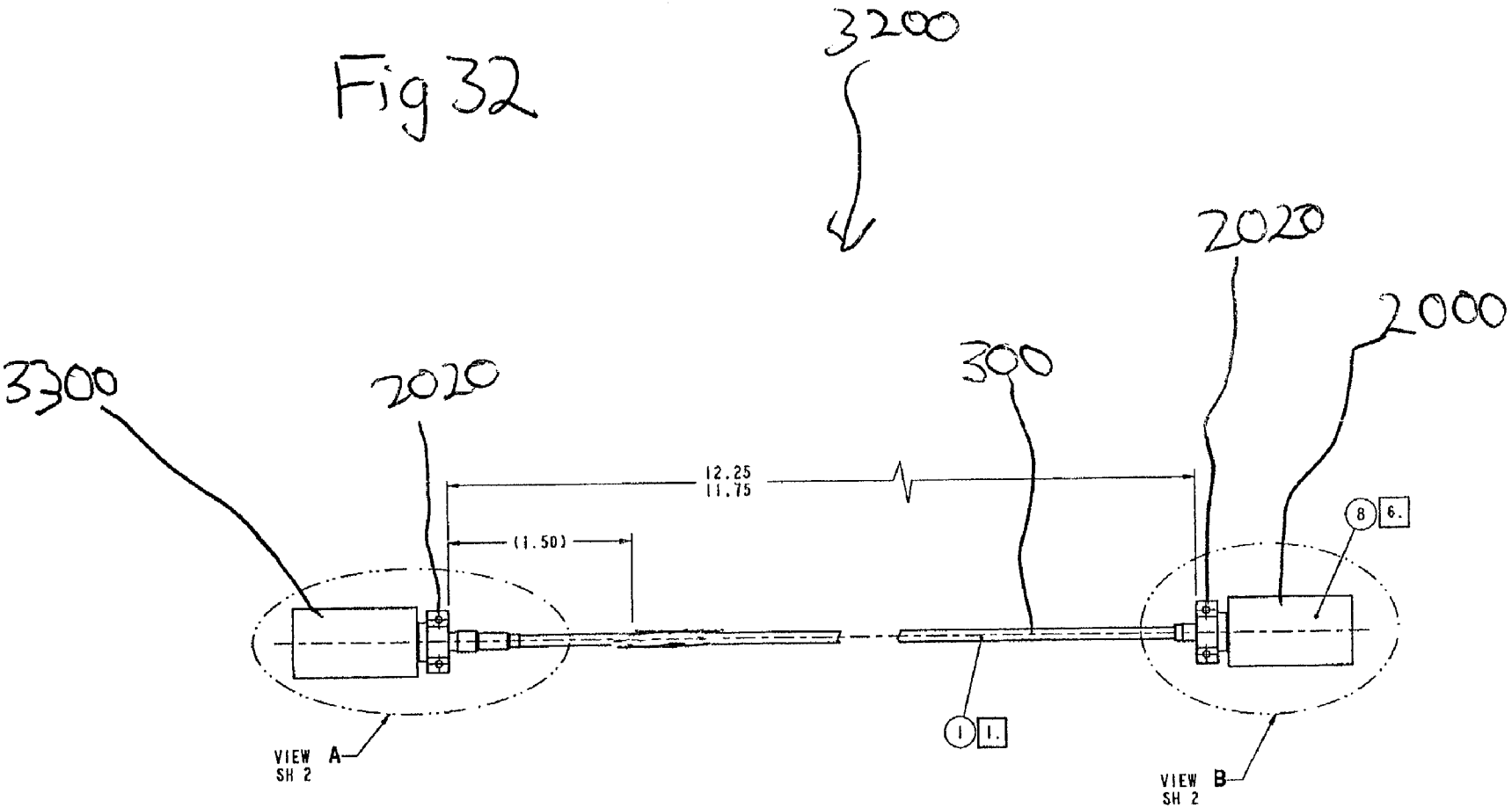
FIG. 32 illustrates the ordnance transfer line illustrated in FIG. 3 connecting a standard loaded HE end fitting illustrated in FIG. 20 to a loaded HE separation end fitting illustrated in FIG. 33 according to the principles of the present invention.

FIG. 32 illustrates yet another embodiment of the present invention. Setup 3200 is essentially similar to setup 1900 in FIG. 19 with the exception that the leftmost loaded HE end fitting 3300 is a separation end fitting. Separation end fittings are different from standard loaded HE end fittings 2000 except, after functioning, ferrule 3310 of end fitting 3300 separates from transfer line 300 while in FIG. 20, ferrule 2030 remains attached to transfer line 300. As a result, some design modifications must be made to the end fitting 2000 to produce separation end fitting 3300. Separation end fittings 3300 are used in launched space vehicles whenever stage separation occurs, functioning of missiles and bombs from aircraft or ships, or in any other function that requires an object to be ejected from another object. The advantage of having the ferrule 3310 separate from transfer line 300 during functioning is that there will be no trailing objects present on the ejected object which could steer the ejected object off course.

Figure 33:
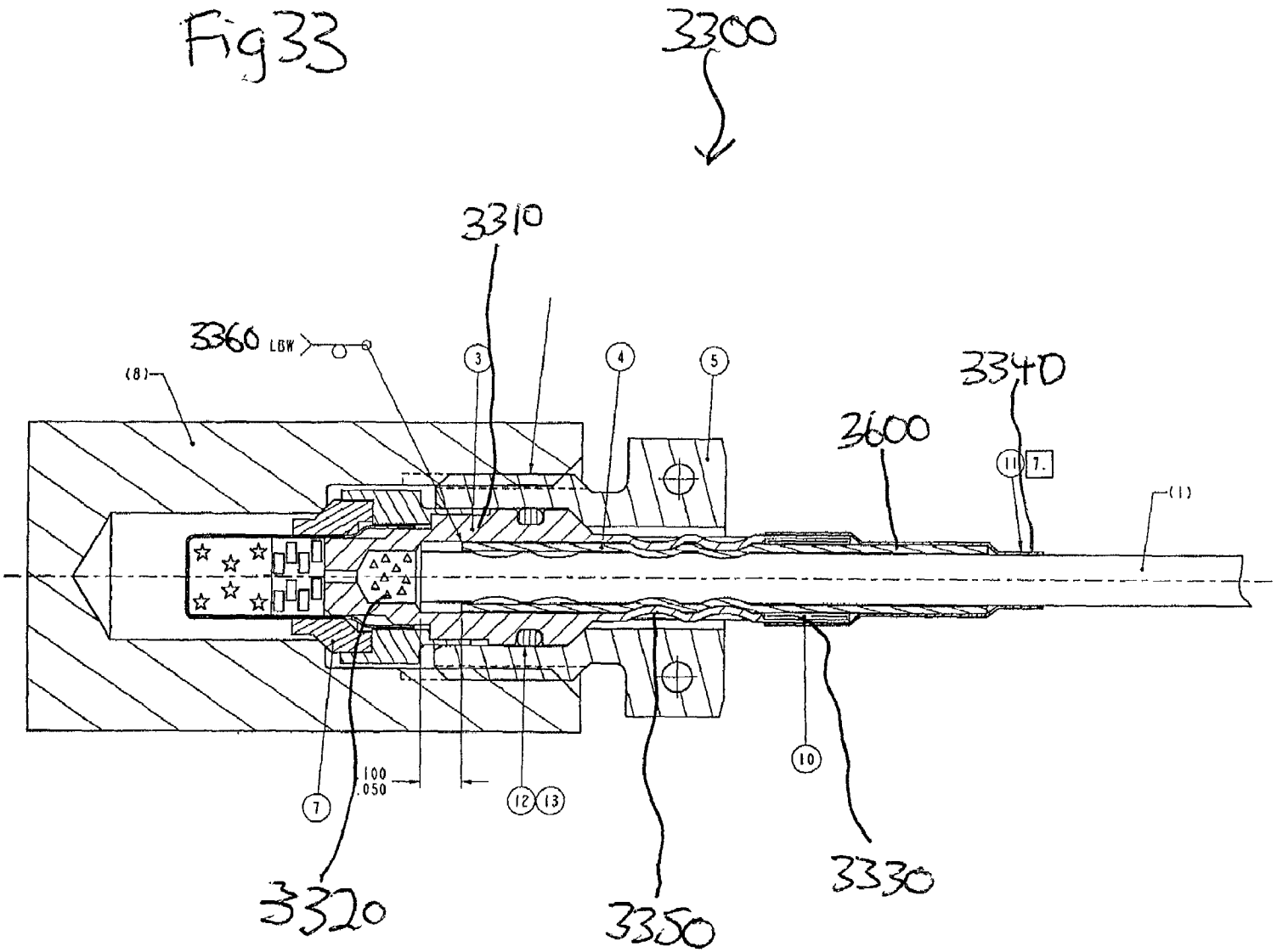
FIG. 33 illustrates a cross-sectional view of a loaded HE separation end fitting according to the principles of the present invention.
Figure 34:
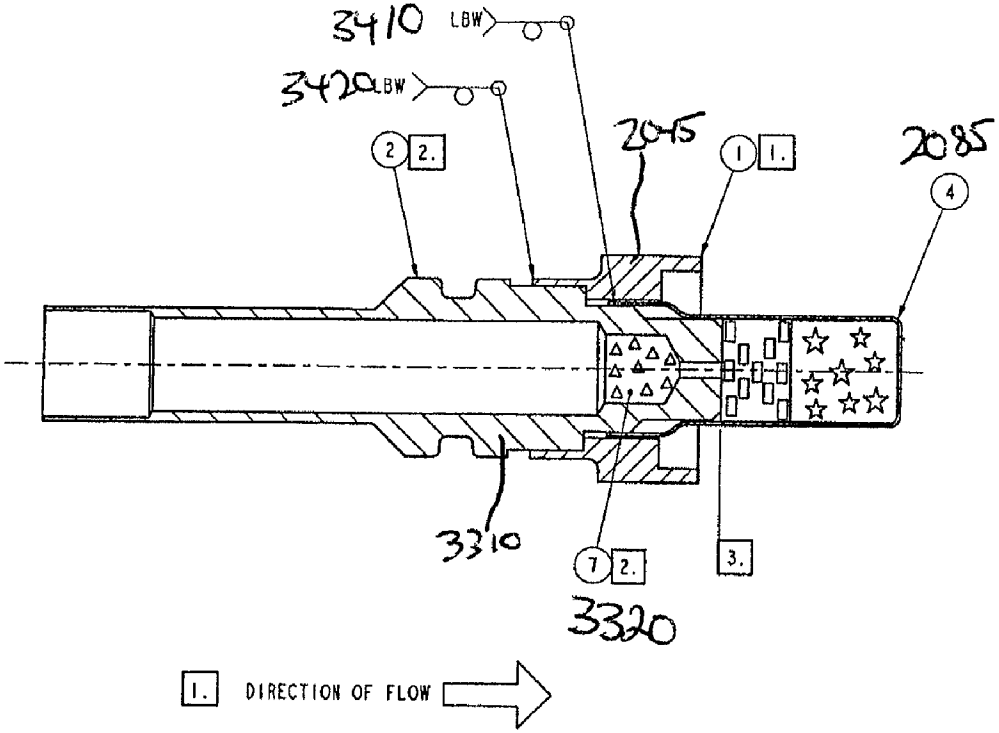
FIG. 34 is a cross-sectional view of a partial assembly of the loaded HE separation end fitting illustrated in FIG. 33 according to the principles of the present invention.
Figure 36B:
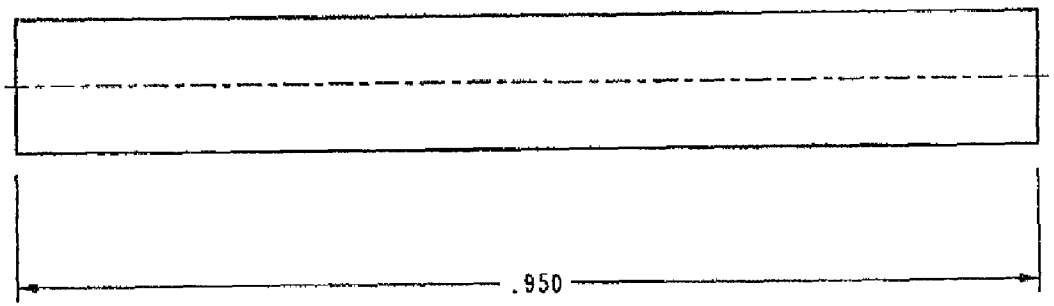
FIGS. 36A and 36B illustrate cross-sectional views of the shrink tubing used in the loaded HE separation end fitting of FIG. 33 according to the principles of the present invention.
Figure 36A:
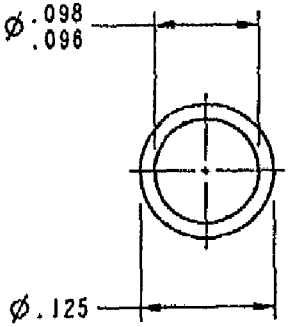

FIG. 33 illustrates a cross-sectional view of the loaded HE separation end fitting 3300 of FIG. 32 and FIGS. 34-36B illustrate, in detail, the differences between separation end fitting 3300 and standard loaded end fitting 2000. Where parts are essentially identical to previously discussed cross-sectional view of standard loaded HE end fitting 2000 of FIG. 20, the same reference numbers are used to denote the same parts. Where parts in FIG. 33 differ substantially from those of FIG. 20, the new reference numeral is used. A special ferrule 3310 is employed in the setup of FIG. 32. Ferrule 3310 differs from ferrule 2030 in FIG. 20 in that ferrule 3310 accommodates a space between transfer line 300 and spit hole 2060 to contain Rapid Deflagration Material (RDM) 3320. RDM 3320 serves to produce sufficient gas pressure when reacted to push ferrule 3310 away from transfer line 300 and essentially separate ferrule 3310 so that ferrule 3310 does not interfere with the course of a launched stage separation space vehicle, missile systems, bomb or other ejected device. It is noted that tubing 200 is staked (or crimped) 2075 near the RDM 3320. Ferrule 3310, sleeve 3600 and tubing 200 are staked again within B-nut 2020 and is denoted as reference numeral 3350. Similar to reinforcement sleeve 3100 used in end fitting 2800 for connection to flexible transfer line 2740, a sleeve 3600 illustrated in FIGS. 36A and 36B is disposed between the tubing 200 of transfer line 300 and ferrule 3310. Sleeve 3100 has an inner diameter of 0.097 inches and an outer diameter of 0.125 inches and has a length of 0.950 inches. As a result, ferrule 3310 has an opening 3510 to accommodate sleeve 3100, tubing 200 and RDC 100. At the very edge 3520, opening 3510 of ferrule 3310 has an inner diameter of 0.148 inches and an outer diameter of 0.158 inches and the remainder 3530 of opening 3510 has an inner diameter of 0.131 inches and an outer diameter of 0.158 inches accommodating the sleeve 3100 that surrounds tubing 200 that encapsulates RDC 100. Cavity 3550 adjacent to cavity 3510 stores the gas generating RDM 3320. Crimping 2075 occurs to tubing 200 near RDM 3320 while portion 3530 of ferrule 3310 is crimped 3350 to sleeve 3600 and to tubing 270. Extreme portion 3520 of ferrule 3310 is glued by adhesive 3330 to sleeve 3600. Shrink tubing 3340 covers a bare portion of transfer line 300, an end portion of sleeve 3600 and the portion 3520 of ferrule 3310 that are glued to each other. Shrink tubing 3340 merely serves to prevent moisture from entering the system prior to functioning. Sleeve 3600 is LBW 3360 to ferrule 3310 near cavity 3550 of ferrule 3310 that houses the RDM 3320. Annular groove 2210 on ferrule 3310 in the separation fitting of FIG. 35B accommodates annular Silicone rubber O-ring 2040 and its dimensions are essentially identical with the loaded HE end fitting of FIG. 20. FIG. 35C illustrates portion 3520 of ferrule 3310 is where shrink tubing 3340 covers and where ferrule 3310 is glued 3330 to sleeve 3600. It is noted that there is no LBW that welds together sleeve 3600 to ferrule 3310 or that welds ferrule 3310 to transfer line 300. It is this lack of LBW that allows ferrule 3310 to separate from transfer line 300 when RDM 3320 deflagrates. Nevertheless, FIG. 34 illustrates LBW's 3410 and 3420 between closure cup 2085 and ferrule 3310 and between retainer 2045 and ferrule 3310. New numbers for the LBW's were required because the reference number for the ferrule changed to 3310.

The above invention discloses a novel transfer line apparatus and end fittings that allow for reactions between HE and HE end fittings, HE to LE end fittings, and LE to LE end fittings. It is also possible for one loaded end fitting to start reactions in one or a plurality of other loaded end fittings simultaneously when placed in a transfer manifold containing other loaded end fittings. In addition, the use of a percussion primer end fitting is also employed that is capable of initiating the burning of the RDC by actuation of a firing pin such as those found in common firearms. Each of these end fittings react with a RDC encapsulated inside a metal tubing that is hermetically sealed to prevent entry of moisture into the system and to prevent the escape of produced gases which could cause burning or other harm along a transfer ordnance line. Some transfer lines may be made highly flexible in portions by coiling the highly flexible portions and reinforcing portions of the transfer line that is coiled and is highly flexible. Highly flexible transfer lines may be used on door hinges or hatch openings. The coiled and highly flexible portions can withstand over 50,000 flexures of a transfer line safely. All transfer lines designed to be semi flexible in that the transfer lines containing end fittings can be bent slightly so that the end fittings may be installed in fixed transfer manifolds thus providing for easy installation. A loaded LE end fitting may be used to ignite a starter cartridge, ignite a pressure cartridge, initiate a flame front, function a pin puller. HE end fittings may be used for all the above in addition to initiating a shape charge for canopies on aircraft. A loaded HE end fitting can be made into a separation fitting for use in stage separation in launched space vehicles, missile systems, bombs or other ejected devices where the ferrule connecting the end fitting to the tubing separates from the tubing upon detonation.

It is to be understood that in no way is the scope of this invention limited to the dimensions of parts illustrated in the figures. It is also to be understood that the scope of this invention is not limited to laser beam welds, with, perhaps the exception of laser beam weld 1065. Furthermore, in no way is this invention to be limited to using stainless steel parts. The dimensions illustrated in the figures, the use of laser beam welds, and the use of stainless steel parts are only preferred embodiments of this invention. In addition, in no way is a LE charge or RDM limited to $Cs_2B_{12}H_{12}$ fuel for a charge booster and $KNO_3$ oxidizer. Furthermore, in no way is an HE explosive limited to HNS with a Lead Azide booster, as these are only the preferred embodiments to this invention and the scope of this invention is far reaching.

While this invention has been particularly shown and described with reference to a preferred embodiment thereof, it will be understood by those skilled in the art that various changes in form and details may be made therein. Therefore, the true scope of the invention will be defined by the appended claims.

What is claimed is:

1. An ordnance energy transfer system, comprising a transfer line, said transfer line including:

an aluminum tube;

a rapid deflagrating material filing said aluminum tube, said rapid deflagrating material having a burn a rate of 1000 to 1500 feet per second;

a semi-flexible stainless steel tube centrally disposed over said aluminum tube, said stainless steel tube being shorter in length than said aluminum tube, each end portion of said stainless steel tube being crimped onto said aluminum tube to hold said aluminum tube in place, wherein an inner surface area of the non-crimped portion of said stainless steel tube is separated from said aluminum tube by 0.006 inches.

2. The system as set forth in claim 1, said aluminum tube having an outer diameter of 0.050 inches.

3. The system as set forth in claim 1, said stainless steel tube having an inner diameter of 0.062 inches and an outer diameter of 0.094 inches.

4. The system as set forth in claim 1, further comprising:

a first end fitting disposed at a first end of said transfer line; and a second end fitting disposed at a second end of said transfer line, said first end fitting being one of a percussion primer end fining, a detonating high energy end fitting and a low energy end fitting, and said second end fitting being one of a detonating high energy end fitting and a low energy end fitting.

5. The system as set forth in claim 4, said percussion primer end fitting comprising:

a ferrule having a crimped portion crimped at a first end of said ferrule over the crimped portion of said first metal tubing, an annular groove disposed at a second end of said ferrule, and an O-ring disposed in said annular groove;

a B-nut disposed over said first end of said ferrule for firmly holding said ferrule in place on said first metal tubing;

a percussion primer disposed in a compartment in said second end of said ferrule; and a closure disk disposed over said percussion primer and closing said compartment, said closure disk being fanned of stainless steel of sufficient thickness to permit said percussion primer to ignite when said closure disk is struck by a firing pin.

6. The system as set forth in claim 5, further comprising a plastic cap removably disposed over said closure disk, said second end of said ferrule and a treaded portion of said B-nut, said plastic cap serving to protect the percussion primer end fining during shelf life and during transportation, said plastic cap being removed to permit said threaded portion of said B-nut to be threaded into a transfer manifold to enable said percussion primer to be ignited.

7. The system as set forth in claim 4, said low energy deflagrating end fitting comprising:

a ferrule having a crimped portion crimped at a first end of said ferrule over the crimped portion of said first metal tubing, an annular groove disposed at a second end of said ferrule, said second end of said ferrule having predetermined slanted portion, wherein said annular groove is formed in said predetermined slanted portion of said second end of said ferrule, and an O-ring disposed in said annular groove;

a low energy booster charge disposed in a void formed along a central axis of said second end portion of said ferrule;

a spit hole formed along a central axis of a middle portion of said ferrule and separating said rapid deflagrating material from said low energy booster charge;

a closure cup fitted into said void for closing said void, said closure cup having a rim welded to said second end of said ferrule; and a B-nut disposed over part of said first end of said ferrule, for firmly holding said ferrule in place on said first metal tubing, and over said middle portion and a part of said second end of said ferrule.

8. The system as set forth in claim 7, further comprising an end cap removably disposed over said closure cup, said second end of said ferrule and a threaded portion of said B-nut, said end cap serving to protect the low energy deflagrating end fitting during shelf life and during transportation, said end cap being removed to permit said threaded portion of said B-nut to be threaded into a transfer manifold.

9. The system as set forth in claim 7, said low energy booster charge comprising $Cs_2B_{12}H_{12}$ mixed with $KNO_3$.

10. The system as set forth in claim 4, said detonating high energy end fitting comprising:

a ferrule having a crimped portion crimped at a first end of said ferrule over the crimped portion of said first metal tubing, an annular groove disposed around a middle portion of said ferrule, and an O-ring disposed in said annular groove;

a special silicone rubber seal annularly disposed around a first portion of a second end of said ferrule;

a stainless steel interface retainer having an annular shape and disposed around a second portion of said second end of said ferrule between said O-ring and said special silicone rubber seal, a rim of the stainless steel interface retainer being welded to the ferrule;

a closure cup having a rim welded to an outside annular surface of said ferrule directly underneath said stainless steel retainer;

a high energy detonation charge and a lead azide booster charge disposed said closure cup, said lead azide booster charge being disposed between said second end portion of said ferrule and said high energy detonation charge;

a spit hole formed along a central axis of said second end of said ferrule and separating said rapid deflagrating material from said lead azide booster charge; and a B-nut disposed over part of said first end of said ferrule, for firmly holding said ferrule in place on said first metal tubing, and over said middle portion, a part of said second end of said ferrule and part of said stainless steel interface retainer.

11. The system as set forth in claim 10, further comprising an end cap removably disposed over said closure cup, said second end of said ferrule and a threaded portion of said B-nut, said end cap serving to protect the detonating high energy end fitting during shelf life and during transportation, said end cap being removed to permit said threaded portion of said B-nut to be threaded into a transfer manifold.

12. The system as set forth in claim 1, said rapid deflagrating material comprising $Cs_2B_{12}H_{12}$ mixed with $KNO_3$.

* * * * *